US007281882B2

(12) United States Patent
Hilfiker et al.

(10) Patent No.: US 7,281,882 B2
(45) **Date of Patent: *Oct. 16, 2007**

(54) RETAINING WALL HAVING POLYMERIC REINFORCING MATS

(75) Inventors: William K. Hilfiker, 2210 Lakeridge Dr., Grapevine, TX (US) 76051; Harold K. Hilfiker, Eureka, CA (US)

(73) Assignee: William K. Hilfiker, Grapevine, TX (US)

( * ) Notice: Subject to any disclaimer, the term of this patent is extended or adjusted under 35 U.S.C. 154(b) by 27 days.

This patent is subject to a terminal disclaimer.

(21) Appl. No.: 11/433,861

(22) Filed: May 11, 2006

(65) Prior Publication Data

US 2006/0204342 A1 Sep. 14, 2006

Related U.S. Application Data

(63) Continuation-in-part of application No. 11/061,343, filed on Feb. 18, 2005, now Pat. No. 7,073,983, which is a continuation-in-part of application No. 10/724,265, filed on Nov. 28, 2003, now Pat. No. 6,857,823.

(51) Int. Cl.
*E02D 17/20* (2006.01)
*E02D 5/00* (2006.01)

(52) U.S. Cl. ..... 405/262; 405/284; 405/285; 405/302.7

(58) Field of Classification Search ..... 405/262, 405/284, 286, 287, 302.4, 302.6, 302.7
See application file for complete search history.

(56) References Cited

U.S. PATENT DOCUMENTS 4,117,686 A 10/1978 Hilfiker ..... 405/284

(Continued)

FOREIGN PATENT DOCUMENTS

| | | |
|---|---|---|
| FR | N 75 07114 | 10/1976 |
| GB | 2 059 484 | 4/1981 |
| GB | 2 131 063 | 6/1984 |
| JP | 08246457 | 9/1996 |

(Continued)

OTHER PUBLICATIONS

Barry R. Christopher, etc., "The Heavy Duty Geogrid Wall," *Civil Engineering*, May 1988, pp. 75-77.

*Primary Examiner*—Tara L. Mayo
(74) *Attorney, Agent, or Firm*—Thelen Reid Brown Raysman & Steiner LLP; John K. Uilkema

(57) ABSTRACT

A soil reinforced retaining wall for an earthen formation is provided by embedding planar soil reinforcing mats in the formation at vertically spaced intervals and securing face mats between the soil reinforcing mats. The face mats include fingers extending distally from the edges thereof for engagement with opposite sides of a complimental face mat, whereby the mats are held in general vertical alignment. Certain of the fingers are of a gently curved configuration to frictionally hold edge portions of the face mats in spaced relationship for compression toward one another to accommodate settlement of the earthen formation, without bulging of the face mats. An L-shaped starter mat is engaged within a recess formed at the foot of the formation to provide an upstanding portion engaged with the lowermost is face mat to hold the mat in a generally vertical orientation. A tail is provided on the uppermost face mat for embedment within the backfill to cap the wall.

4 Claims, 22 Drawing Sheets

U.S. PATENT DOCUMENTS

| | | | | |
|---|---|---|---|---|
| 4,324,508 | A | 4/1982 | Hilfiker et al. | 405/284 |
| 4,329,089 | A | 5/1982 | Hilfiker et al. | 405/262 |
| 4,391,557 | A | 7/1983 | Hilfiker et al. | 405/287 |
| 4,505,621 | A | 3/1985 | Hilfiker et al. | 405/284 |
| 4,643,618 | A | 2/1987 | Hilfiker et al. | 405/287 |
| 4,856,939 | A * | 8/1989 | Hilfiker | 405/284 |
| 4,929,125 | A | 5/1990 | Hilfiker | 405/262 |
| 4,961,673 | A | 10/1990 | Pagano et al. | 405/287 |
| 5,076,735 | A | 12/1991 | Hilfiker | 405/284 |
| 5,161,917 | A | 11/1992 | Papetti | 405/284 |
| 5,531,547 | A | 7/1996 | Shimada | 405/262 |
| 5,622,455 | A | 4/1997 | Anderson et al. | 405/262 |
| 5,722,799 | A | 3/1998 | Hilfiker | 405/262 |
| 5,733,072 | A | 3/1998 | Hilfiker et al. | 405/284 |
| 5,975,810 | A * | 11/1999 | Taylor et al. | 405/262 |
| 6,296,422 | B1 | 10/2001 | Ferraiolo | 405/262 |
| 6,345,934 | B1 | 2/2002 | Jailoux et al. | 405/262 |
| 6,357,970 | B1 | 3/2002 | Hilfiker et al. | 405/302.7 |
| 6,764,252 | B2 | 7/2004 | Banting | 405/262 |
| 2006/0204343 | A1* | 9/2006 | Kallen | 405/284 |
| 2006/0239783 | A1* | 10/2006 | Kallen | 405/284 |
| 2007/0104543 | A1* | 5/2007 | Heathcott et al. | 405/302.7 |

* cited by examiner

RETAINING WALL HAVING POLYMERIC REINFORCING MATS

RELATED APPLICATION

This is a Continuation-in-Part of U.S. application Ser. No. 11/061,343 filed Feb. 18, 2005, now U.S. Pat. No. 7,073,983, which in turn is a continuation-in-part of U.S. application Ser. No. 10/724,265, filed Nov. 28, 2003, now U.S. Pat. No. 6,857,823.

BACKGROUND OF THE INVENTION

The present invention relates to a soil reinforced retaining wall for earthen formations and, in particular, is directed to such a wall wherein the soil reinforcing mats are of a planar configuration and successively placed in the formation at vertically spaced intervals, and separate face mats are secured to the soil reinforcing mats at the face of the formation. It is especially concerned with such an arrangement wherein the lift (i.e. the distance between successive soil reinforcing mats) may be increased as compared to walls presently in use. It is also concerned with a new face mat construction comprised of paired separate face mat elements secured one above the other in edge-to-edge relationship and an improved construction for anchoring such elements in vertical alignment. The invention also provides an improved construction which accommodates settlement of an earthen retaining wall having a wire face, without bowing of the face. It also provides an improved method for starting and capping construction of the wall so that the face mats are maintained in generally vertical alignment.

A soil reinforced retaining wall designed to accommodate an increased lift between soil reinforcing mats may be seen in U.S. Pat. No. 5,722,799 to William K. Hilfiker, one of the inventors herein. The face mat shown in FIG. 9 of that patent is similar to the face mats of the present invention. As contrasted to the present invention, however, the wire wall of that patent employs angle-shaped soil reinforcing mats with portions which extend over wire face mats, and increasing the lift requires a specially constructed unitary face mat which extends over the height of the lift. The wall of the present invention, in contrast, employs planar soil reinforcing mats and face panel mats which may comprise separate paired elements secured together in edge-to-edge relationship, with anchors to stabilize the elements and secure them in vertical alignment.

Prior art arrangements employing generally planar soil reinforcing mats may be seen in U.S. Pat. Nos. 4,329,089 and 5,622,455. The walls of these patents employ special connectors between the soil reinforcing mats and face elements, and do not have separate paired face panel elements of the type used in the present invention, or the provision of anchors to secure these elements in vertical alignment.

A prior art wire wall construction provided with compressible face elements to accommodate settling of an earthen formation, without bowing of the face elements, may be seen in U.S. Pat. No. 6,357,970. As contrasted to the present invention, however, the wall of this patent employs L-shaped soil reinforcing mats having vertically extending elements which extend over the face of the wall.

SUMMARY OF THE INVENTION

The present invention provides a structure for retaining and reinforcing an earthen formation by means of planar soil reinforcing mats which are embedded in the formation at vertically spaced intervals and welded wire face mats which are disposed at the face of the formation between the successive soil reinforcing mats. The face mats are held in place by being engaged behind transversely extending elements of the soil reinforcing mats. The face mats can either be unitary, or comprised paired separate face mat elements secured one above the other in edge-to-edge relationship. Where the face mats are comprised of such paired separate face mat elements, stabilizing anchors are embedded in the formation intermediate the successive soil reinforcing mats and secured to the face mats to maintain the paired is face mat elements in vertical alignment.

In the method of the invention, the planar soil reinforcing mats are successively placed at the face of the formation in vertically spaced relationship, starting at the bottom and working up, with each soil reinforcing mat having a separate face mat secured thereto and extending upwardly therefrom. Backfill is placed over each successive soil reinforcing mat and compacted into place against the face mat extending upwardly therefrom. Each successive soil reinforcing mat is engaged with the face mat therebeneath to secure the face mat against outward displacement.

The apparatus and method accommodates settlement of the earthen formation, without bowing of the face panels, through means of compressible members or frictionally engaged members which support the soil reinforcing mats on the face mats, and/or frangible supports which space the respective face panels from the soil reinforcing mats therebeneath.

A principal object of the invention is to provide an apparatus and method for the fabrication of soil reinforced earthen retaining walls wherein the soil reinforcing members comprise planar mats and the face members comprise welded wire mats separate from the soil reinforcing mats, which are secured behind transverse wires of the reinforcing mats.

Another object of the invention is to provide such a method and apparatus wherein the face mats comprise paired separate elements secured one above the other in edge-to-edge relationship to increase the depth of the lift between successive soil reinforcing mats.

Another object related to the later object is to provide such a method and apparatus wherein soil may be backfilled and compacted into place behind the lower of such paired face mat elements before it is backfilled and compacted into place above the upper of such elements.

Still another object is to provide a means to anchor such paired face elements to the earthen formation so as to maintain the elements in vertical alignment.

A further and more general object of the invention is to provide an apparatus and method for constructing a soil reinforced earthen retaining wall through means of flat welded wire mats which may be economically manufactured and easily transported.

Still another and more specific object of the invention is to provide an apparatus and method for constructing an earthen retaining wall wherein separate flat soil reinforcing mats and face mat elements are secured together without the requirement of specially manufactured connectors.

A further object of the invention is to provide an apparatus and method for retaining an earthen formation wherein soil reinforcement is provided by a flat welded wire mat embedded within the formation and a face is provided by a separate welded wire face mat engaged behind a transversely extending wire of the soil reinforcing mat.

Still a further object of the invention is to provide an apparatus and method for retaining an earthen formation wherein soil reinforcement is provided by flat polymer geogrids embedded within the formation and the face is provided by a separate welded wire face mats engaged behind a transversely extending element of the geogrid.

Another object related to the later object is to provide such an apparatus and method wherein welded wire face mats engaged behind the transverse wires of the soil reinforcing mats are secured to one another by interdigitating overlapping fingers extending from the face mats.

These and other objects will become more apparent when viewed in light of the following detailed description and accompanying drawings.

DESCRIPTION OF THE PREFERRED EMBODIMENTS

Figure 1:
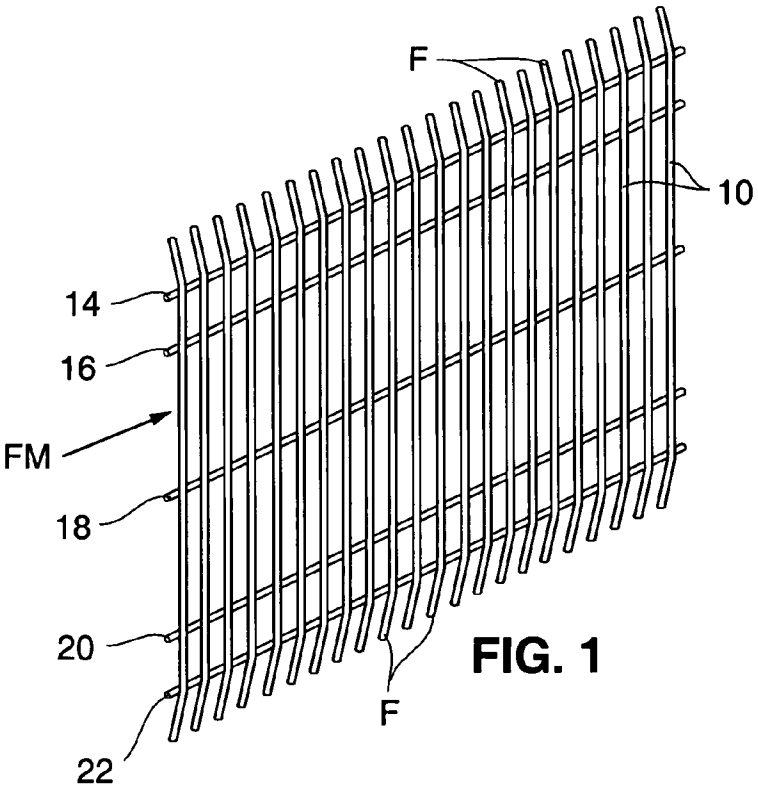
FIG. 1 is a perspective view of a unitary face mat of the present invention.

FIG. 1 shows a face mat, designated FM, of the type which may be used in present invention. This mat is of a welded wire construction and comprises vertically extending wires 10 spaced from another by approximately two inches and horizontally extending wires 14, 16, 18, 20 and 22 extending transversely across and welded to the vertically extending wires. Typically, the wire size of the face mat is W3.5 to W12. While the proportions of the face mat FM may vary, in one exemplary embodiment designed for use in temporary walls, where a single face mat element spans the full lift between successive soil reinforcing mats, the face mat has a width of six feet and the height of two feet, measured between the uppermost and lowermost transversely extending wires 14 and 22, respectively. The face mat for a permanent wall embodiment of the invention may be comprised of paired face mat elements secured one above the other and edge-to-edge relationship. The respective elements of such a mat would typically have a width of six feet and a height of one and a half feet, as measured between the uppermost and lowermost transverse wires 14 and 22. In these exemplary embodiments, the wires 14 and 16 would typically be spaced by approximately three inches, as would wires 20 and 22. The transversely extending wire 18 is positioned approximately midway between the wires 16 and 20.

The vertically extending wires 10 extend distally beyond the uppermost and lowermost transversely extending wires 14 and 22, respectively, to provide fingers F inclined backwardly relative to the mat at an angle of from five to 10 degrees from vertical. In a typical embodiment, these fingers have a length of approximately four inches. The finger length may be extended to accommodate vertical compression of a wall which results from settling of the retained formations.

Figure 2:
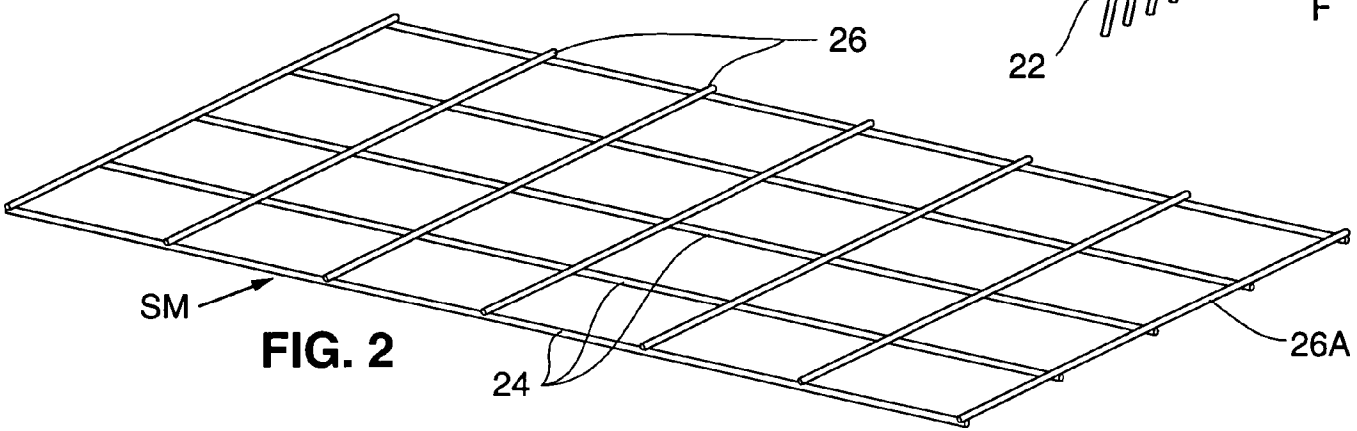
FIG. 2 is a perspective view of the soil reinforcing mat of the invention.

The welded wire soil reinforcing mat of FIG. 2, designated SM, comprises longitudinal wires 24 typically spaced from one another by from 6 to 12 inches and transversely extending wires 26 welded to and extending across the longitudinal wires at spaced intervals, typically in the range of 12 to 24 inches. While the width of the mats SM may vary, a typical width dimension is three and a half feet. The length of the mats SM will vary, depending upon soil conditions and the size of the wall being constructed. The longitudinal wires 24 are typically constructed of W4.5 to W14 wire and the transverse wires 26 are typically constructed of W4.0 to W4.5 wire. The soil reinforcing mats SM are of a planar (meaning flat) configuration. Each soil reinforcing mat terminates at a transversely extending wire 26A at one end thereof. In an assembled wall, the wire 26A extends across the face of a soil formation being reinforced and the fingers F of the face mats FM extend behind the wires 26A.

Figure 3:
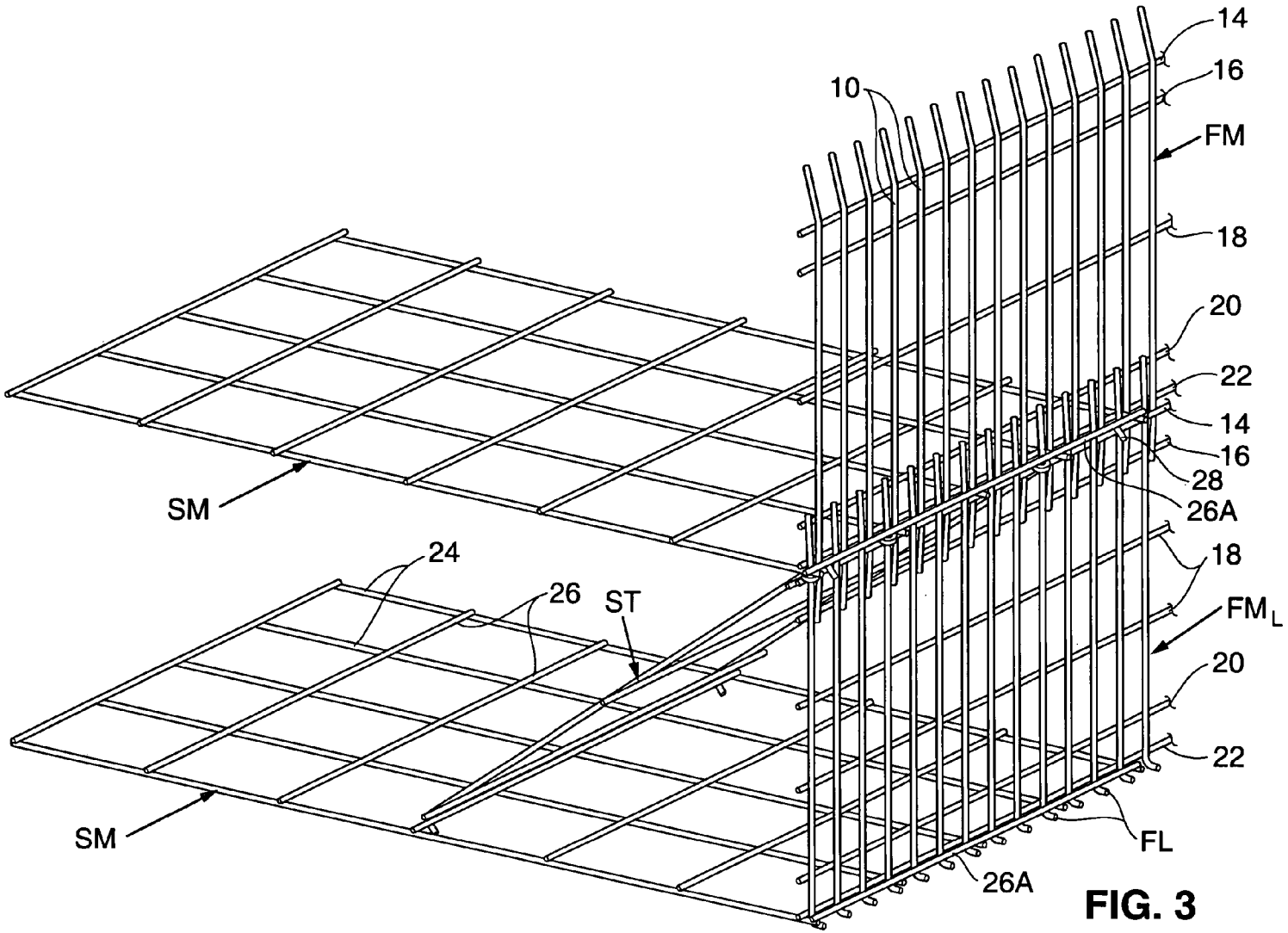
FIG. 3 is a perspective view, with soil removed for purposes of illustration, illustrating how a lowermost and next successive soil reinforcing mat would be placed in constructing a retaining wall according to the present invention, with unitary face mats shown in place.

FIG. 3 diagrammatically illustrates how the components are assembled to create the first lift of a soil reinforced wall. As there pictured, however, no soil is shown in place, in order that the construction and inter-relationship of the wire elements may be better observed. The components comprise a face mat FM, soil reinforcing mats SM, stiffener mats ST and modified lower face mats $FM_L$. The modified face mat $FM_L$ corresponds to the face mats FM, except that the lower fingers, designated $F_L$ are bent outwardly at 90° to the vertical wires 10 and that a pair of horizontal transversely extending intermediate wires 18 are provided. The wire size and proportions of the mats $FM_L$ correspond generally to that of the mats FM. In the mat $FM_L$, the paired wires 18 are spaced from another by approximately four to five inches and generally centered intermediate to the wires 16 and 20.

Figure 4:
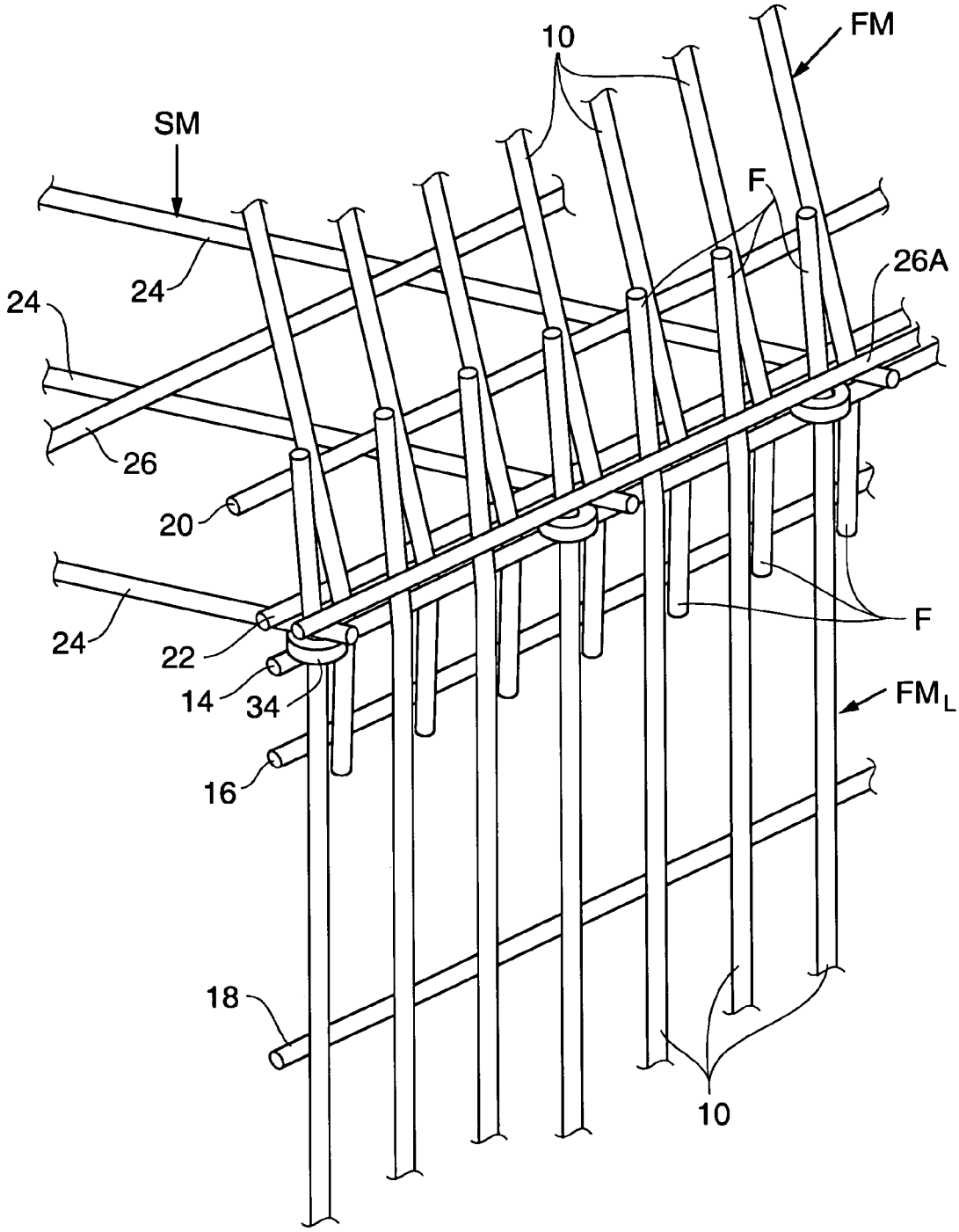
FIG. 4 is an enlarged perspective view illustrating a pair of face mat elements of the present invention engaged with one another and held in place by a soil reinforcing mat, as they would appear prior to movement of the upper face mat shown therein to its fully erected vertical disposition.
Figure 5:
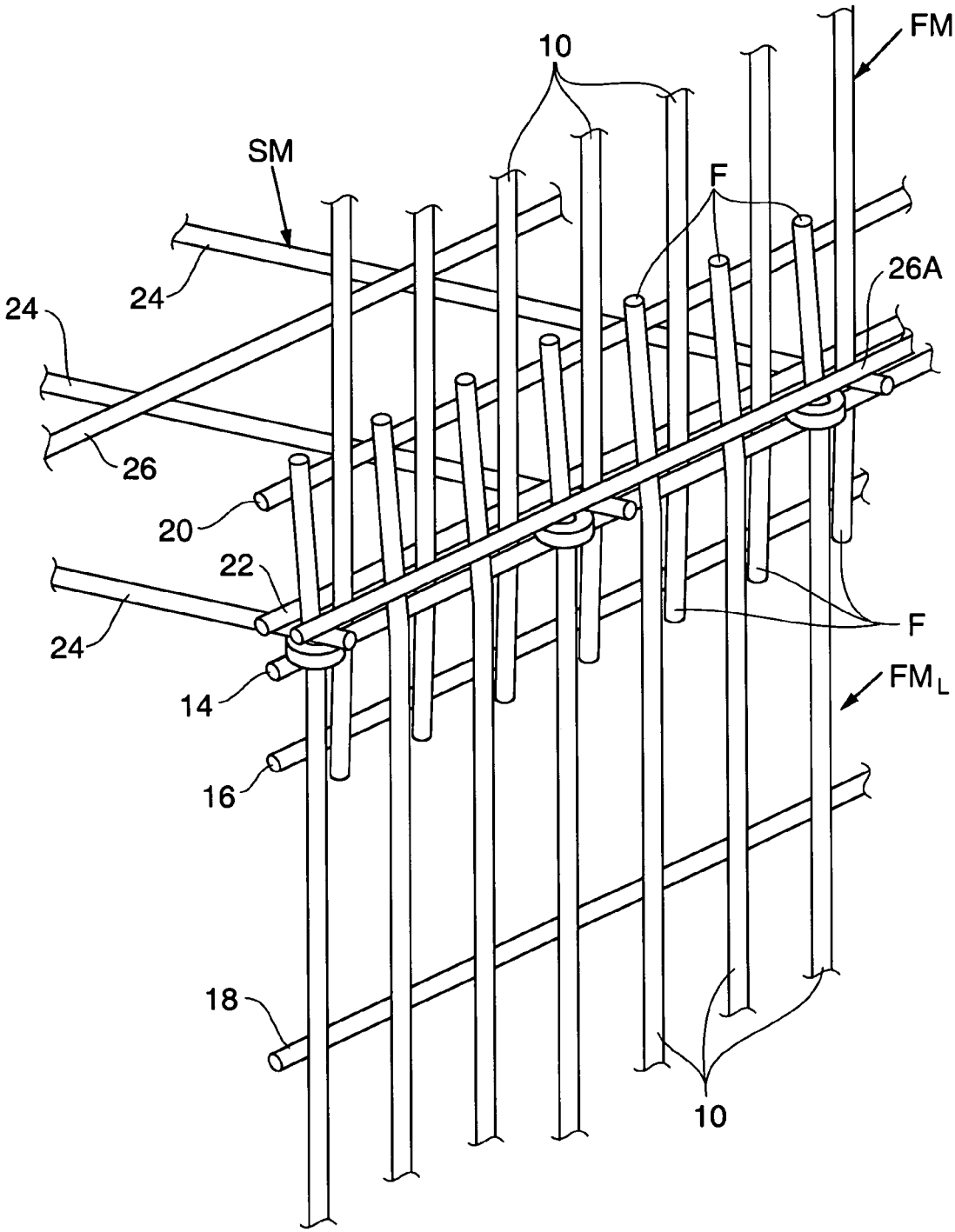
FIG. 5 is a perspective view corresponding to that of the FIG. 4, illustrating the upper face mat therein after it has moved to the fully erected vertical disposition.

The soil reinforcing and retaining elements are assembled into the configuration shown in FIG. 3 by the following sequence of steps:

1. lowermost soil reinforcing mat SM is placed horizontally on the soil at the foot of the formation;
2. modified face mat $FM_L$ is placed above the lowermost soil reinforcing mat SM so that fingers FL hook beneath the outermost transverse wire 26A of the lowermost soil reinforcing mat SM;
3. stiffener mats ST are secured between the lowermost soil reinforcing mat SM and the face mat $FM_L$ through means of hog rings 28 and hooked ends 30 which engage over one of the wires 26 of the mat SM and the wire 14 of the mat $FM_2$ (see FIG. 7);
4. after placing a filter mat (not illustrated in FIG. 3) behind the face mat $FM_L$, soil is backfilled and compacted over the lowermost soil mat SM and against the mat $FM_L$to the level of the uppermost transversely extending wire 14 of the mat $FM_L$;
5. next successive soil reinforcing mat SM is placed on the backfill, with its outermost transversely extending wire 26A extending across the face of the formation and in front of the fingers F of the mat $FM_L$;
6. next successive face mat FM is placed above the upper mat SM as shown in FIG. 3 so that the fingers F at the top of the face mat $FM_L$ and the bottom of the face mat FM are both disposed behind the uppermost transversely extending wire 26A of the upper mat SM, with the fingers interdigitating and extending over into the front of the respective wires 14, 16, 20 and 22 (when initially placed in the later condition, the fingers will incline the mat FM backwardly toward the soil formation being reinforced, as shown in FIG. 4); and
7. a filter mat is placed behind the face mat FM and soil is then backfilled over the upper mat SM shown in FIG. 3 and compacted into place to force the mat FM to the vertical position shown in FIG. 5.

FIG. 4 is an enlarged perspective view of the joinder between the face mats FM and $FM_L$ and the intermediate soil reinforcing mat SM therebetween. As there shown, the mat FM is inclined backwardly toward the earthen formation (not shown) being reinforced as the result of the inclination of the fingers F of the respective face mats FM and $FM_L$ and their engagement over the wires 14, 16, 20 and 22. From this figure, it will also be seen that the fingers F extend behind the transversely extending wire 26A of the intermediate soil reinforcing mat SM and that, thus, the reinforcing mat serves to secure the face mats FM and $FM_L$ against outward displacement relative to the earthen formation.

Figure 10:
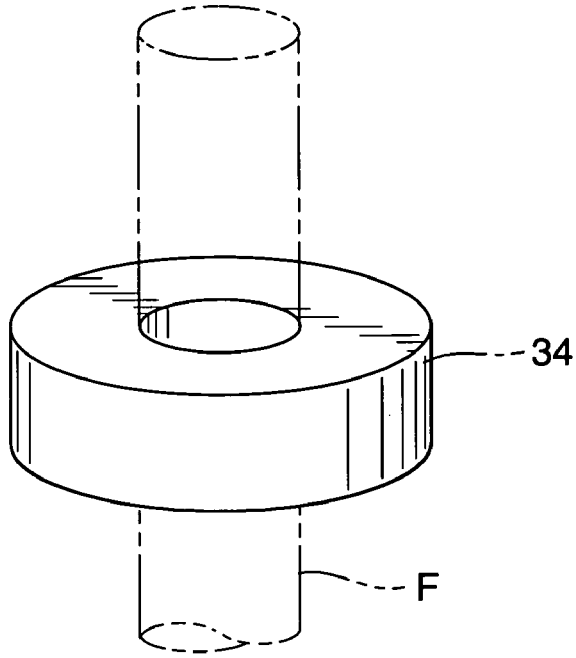
FIG. 10 is a perspective view of the compressible support member of the invention, as it would appear in place on a wire shown in phantom.

FIG. 4 also shows how the intermediate soil reinforcing mat SM is supported on the uppermost transversely extending wire 14 of the face mat $FM_L$ through means of compressible support members 34 of a toroidal configuration. The members 34, as may be seen in enlarged detail in FIG. 10, are received around the fingers F of the lower face mat $FM_L$ so as to be sandwiched between the transversely extending wire 14 of the mat and certain of the longitudinally extending wires 24 of the soil reinforcing mat SM. The support members are fabricated of a crushable material, such as STYROFOAM. Their purpose is to crush in response to settling of the soil reinforcing mat SM as the earthen formation settles, to thus permit the soil reinforcing mat to move downwardly, without bowing of the face mat $FM_L$ upon which the soil reinforcing mat is supported. The support members 34 may be of any desired dimension to allow for such settlement, for example a depth of an inch or more. To accommodate a larger degree of such settlement, without bowing of the lower face mat, the fingers F may be extended and the compressible members 34 may be of an increased depth. As shown, the members 34 are on each fourth vertically extending wire of the mat $FM_L$. The number and spacing of the compressible members are chosen so that the members provide adequate support and do not prematurely crush.

The stiffener mat ST has been omitted from FIG. 4 for the purposes of simplification of the illustration. It should be appreciated that the hooked ends 28 of the mat ST would be engaged over the transversely extending wire 14 of the face mat $FM_L$ and secured in place by the hog rings 30 (see FIG. 7). Successive face mats above the face mat FM shown in FIGS. 3 and 4 do not require stiffener mats to hold the face mats as backfill soil is placed, since the fingers F perform this function. Accordingly, for these successive mats, the intersection between the face mats and soil reinforcing mat is as shown in FIG. 4, without the presence of stiffener mats ST.

FIG. 5 corresponds to FIG. 4, except that the upper face mat FM shown therein is in vertical alignment with the lower face mat $FM_L$. This occurs as the result of the upper mat being forced outwardly by backfilling and compacting soil (not illustrated) therebehind. In viewing FIGS. 4 and 5, it should also be appreciated that the filter mats 36 which would be behind the face mats $FM_L$ and FM are not shown. Such mats would actually be behind the face mats (see FIG. 6) so that soil backfilled and compacted into place bears against the face mats and does not slough away. The presence of such filter mats enables the backfilling and compaction of soil behind the mat FM to force the mat to a vertical condition, as shown in FIG. 5. Compaction is adequate when such vertical orientation is achieved. As the face FM moves to vertical, the fingers F of the face mats FM and $FM_L$ are forced outwardly by the transversely extending wires over which they engage to the condition shown in FIG. 5 wherein the fingers are moved to an essentially vertical orientation.

The Temporary Retaining Wall Embodiment

Figure 6:
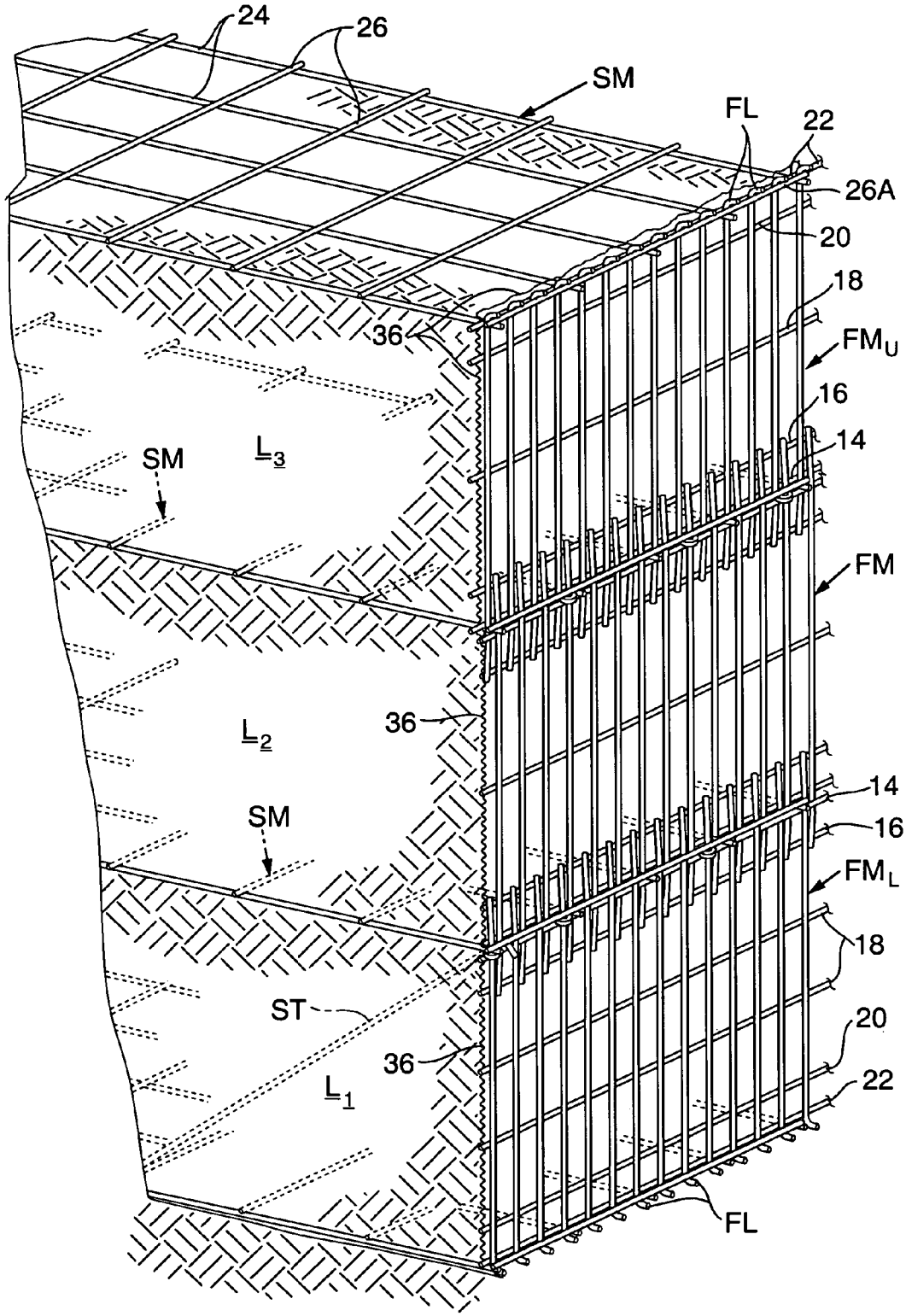
FIG. 6 is a perspective view of a temporary retaining wall constructed according to a first embodiment of the present invention.
Figure 7:
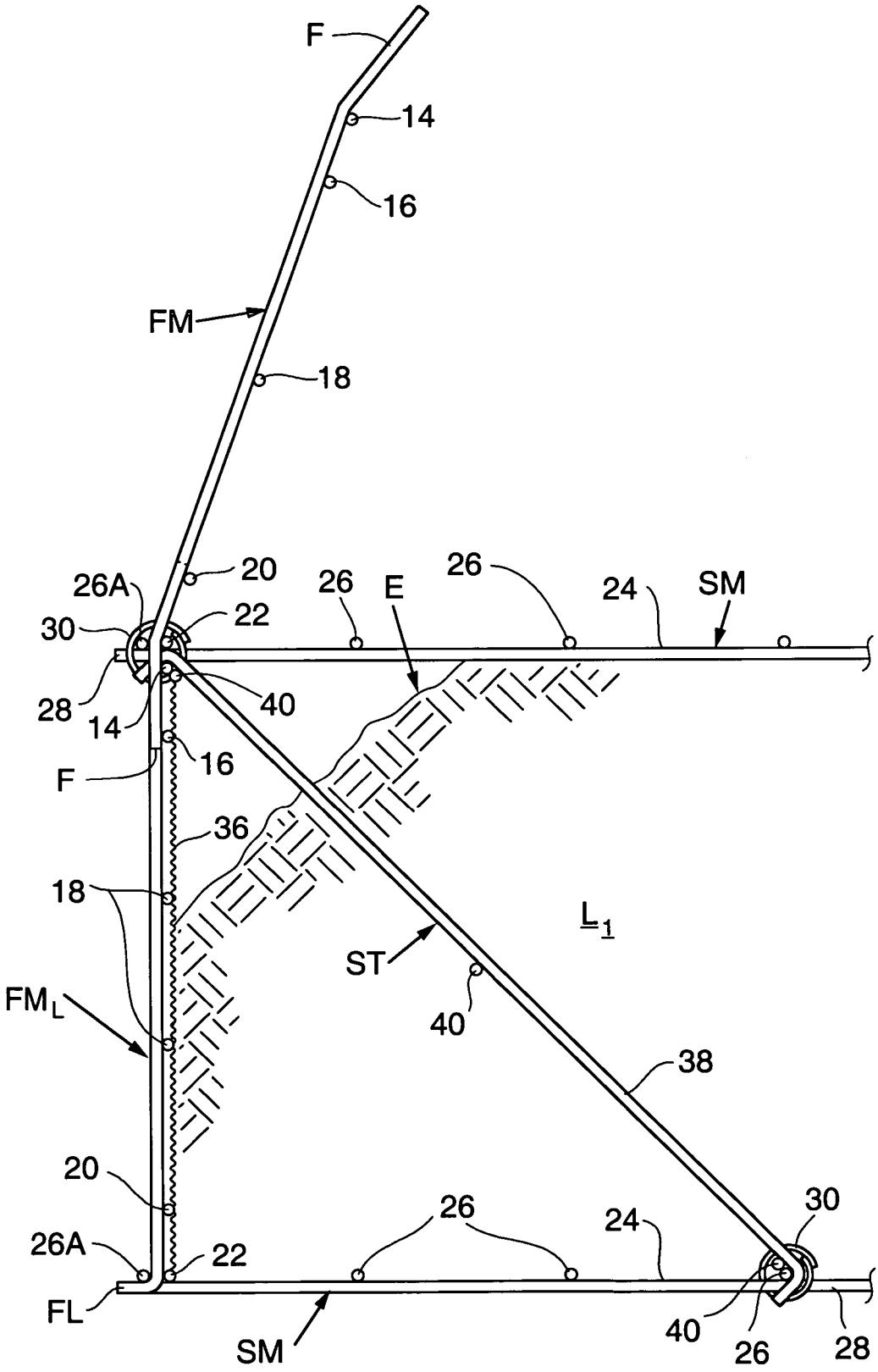
FIG. 7 is a cross-sectional elevational view of the temporary retaining wall of FIG. 6, shown with the first lift in place and the second lift about to be placed.

This embodiment is shown in FIGS. 6 and 7 and, for purposes of illustration, is illustrated as having three successive lifts $L_1$, $L_2$ and $L_3$, respectively. Although only three such lifts are shown, a wall would typically have many more intermediate lifts corresponding to the lift $L_2$.

The wall shown in FIGS. 6 and 7 is "temporary" in the sense that it is intended to have a life of only a few years and does not have the corrosion resistance and sacrificial steel of permanent long life walls. The wires of the mat elements of the temporary wall are generally not zinc coated and are of a size smaller than would typically be employed in a permanent wall. For example, the longitudinal wires 24 of the soil reinforcing mats SM of the temporary wall would typically have a wire size of from W4.5 to W9.5, as contrasted to the size range of W9.5 to W14.0 for a permanent wall.

The lifts $L_1$, $L_2$ and $L_3$ of the temporary wall typically have a depth of two feet and each of the soil reinforcing mats SM provides a soil reinforcing function for the lifts to either side thereof.

As shown in FIG. 6, filter mats 36 are in place behind the face mats FM. These filter mats are of conventional construction and serve to retain the soil therebehind against sloughing through the face mats, while permitting water to pass therethrough. They also serve, as described in the foregoing, to enable the backfill soil which is compacted into place to impart force to the face mats.

The first two lifts $L_1$, and $L_2$ of FIG. 6 are constructed in the manner which has been described with respect to FIG. 3.

FIG. 7 is an enlarged cross-section of the soil reinforced retaining wall of FIG. 6, shown with backfill E in place in the first lift, except for that portion at the upper front end of the lift. This is the condition the lift would assume initially upon placement and compaction of the backfill, prior to placement of the soil reinforcing mat SM on top of the backfill of the lift $L_1$. As there shown, the stiffener mat ST comprised of longitudinal wires 38 with transverse wires 40 welded there across, is engaged between the lowermost soil reinforcing mat SM and the face mat $FM_L$. The hooked ends 28 of the stiffener mat engage over transverse wires of the mat SM and $FM_L$ to maintain the mat $FM_L$ in vertical orientation, as the backfill is placed and compacted. The second lift face mat FM in FIG. 7 is shown inclined backwardly toward the formation in the condition it assumes prior to backfilling and compaction of the second lift.

As shown in FIG. 6, the third, and topmost lift $L_3$ has a modified face mat $FM_U$ of a construction corresponding to that of the mat $FM_L$, except that it is inverted so that the fingers F extend downwardly into interdigitating relationship with the face mat FM therebelow and the fingers FL extend outwardly from the top of the mat. The outwardly extending fingers are hooked behind the transversely extending wire 26A of a topmost soil reinforcing mat SM placed on the top of the backfill of lift $L_3$.

In the course of constructing lift $L_3$, the face mat $FM_U$ is initially is inclined rearwardly, similarly to the face mat FM shown in FIG. 7. As soil is backfilled and compacted into lift $L_3$, the mat FMU is forced to the vertical condition. The topmost soil reinforcing mat SM is then placed. Some backfill is also placed over the topmost soil reinforcing mat SM to hold it in place.

The components of the modified face mat $FM_U$ are identical to those of the face mat $FM_L$ and are designated by like numerals and letters. Because of this, the transverse wires 14 and 16 of the mat $FM_U$ are at the bottom of the mat and the transverse wires 20 and 22 are at the top of the mat.

Permanent Retaining Wall Embodiment

This embodiment differs from the temporary retaining wall embodiment primarily in that the face mat for each successive lift is comprised of a pair of face mat elements secured one above the other in edge-to-edge relationship, with an intermediate stabilizing anchor mat embedded in the formation to hold face mat elements in vertical alignment. The construction of each respective face mat element is essentially the same as the face mats of the temporary retaining wall embodiment, except that the face mat elements of the permanent wall are of a lesser height. (For example, each of the face mat elements of the permanent wall may have a height of one and a half feet.) Thus, the permanent wall embodiment readily accommodates increased height lifts, such as the three foot lifts now allowed for MSE walls by ASHTO (American Society of Highway Transportation Officials). Fabricating a three foot lift with a face mat comprised of one and a half foot face elements secured one above the other and edge-to-edge relationship has the advantage that the backfill soil behind each one and a half foot face element may be backfilled and compacted before the placement of the next element. Thus, good and uniform backfill and compaction can be achieved, even though the lift is three feet high.

Figure 9:
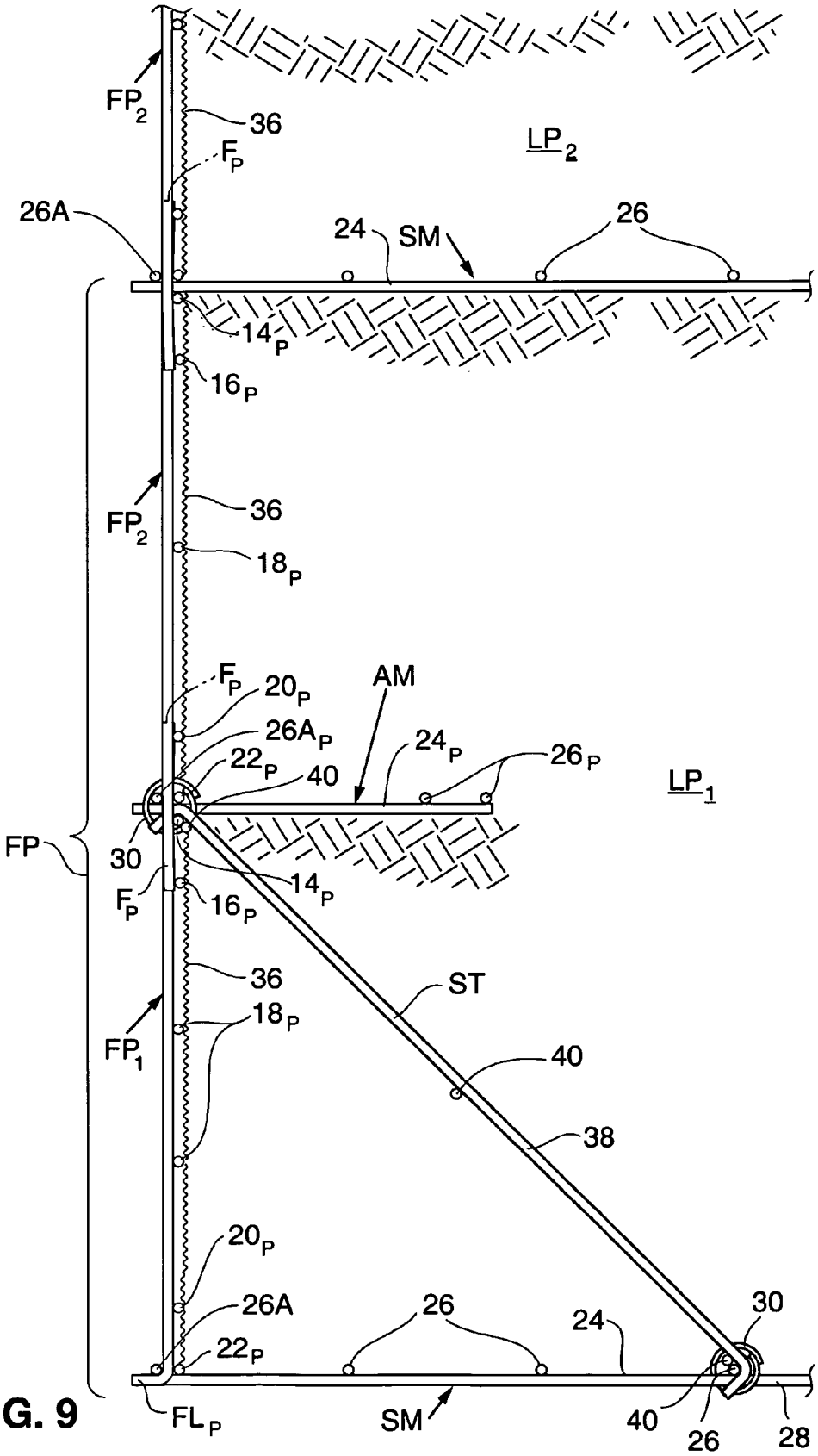
FIG. 9 is a cross-sectional elevational view of the permanent wall of FIG. 8.

The face mat of the permanent retaining wall embodiment is designated in its entirety by the character FP, as may be seen in FIG. 9. As there shown, the first lift, designated $LP_1$ is faced by face panel elements $FP_1$ and $FP_2$ secured in edge-to-edge relationship. Except for its reduced height (one and a half feet as contrasted to two feet), the face mat element $FP_1$ corresponds in construction to the modified lower face mat $FM_L$. Similarly, the face mat $FP_2$, except for its height, corresponds to the face mat FM. The parts of the face mat elements $FP_1$ and $FP_2$ corresponding to those of the face mats FM and $FM_L$ are designated by like numerals, followed by the subscript P, as follows:

Fingers $F_P$
Fingers $FL_P$
Vertical Wires $\mathbf{10}_P$
Horizontal Wires $\mathbf{14}_P$
Horizontal Wires $\mathbf{16}_P$
Horizontal Wires $\mathbf{18}_P$
Horizontal Wires $\mathbf{20}_P$
Horizontal Wires $\mathbf{22}_P$ The soil reinforcing mats of the permanent wall embodiment are of the same construction as that of the temporary retaining wall embodiment, except that they are made of heavier wire to increase their strength and the amount of sacrificial steel available, and that they are zinc coated for corrosion resistance. Accordingly, these mats are also designated SM, with the longitudinal wires thereof designated 24 and the transverse wires designated 26 and 26A. In a typical embodiment of the permanent wall, the longitudinal wires have a size of W9.5 to W14 and the transverse wires have a size of W4.0 to 4.5.

The lowermost face panel element $FP_1$ is initially supported by a stiffener mat ST corresponding to that of the temporary retaining wall embodiment. As seen in FIG. 9, the components of this mat are designated by the same numbers used for the stiffener mat of the temporary retaining wall embodiment. Like the temporary wall embodiment, the stiffener mats are held in place by hog rings 30.

The permanent wall embodiment has as an additional element an intermediate anchor mat AM. The anchor mat AM is of a construction similar to the soil reinforcing mats SM, except that it is much shorter (generally half or less the length of the mats SM). The elements of the anchor mats AM are designated by numerals corresponding to those of the soil reinforcing mats SM, followed by the subscript P, as follows:

Longitudinal wires $\mathbf{24}_P$

Transversely extending wires $\mathbf{26}_P$

Transversely extending wires $\mathbf{26}A_P$

The permanent wall is erected by a sequence essentially the same as the temporary wall, except that each lift between successive soil reinforcing mats SM is backfilled and compacted in two stages. The first stage being up to the level of the anchor mat AM and the second stage being up to the level of the next successive soil reinforcing mat SM. During the course of such construction, the lowermost soil reinforcing mat SM is first placed at the bottom of the formation and the first face mat element $FP_1$ is secured thereto so that the fingers $FL_P$ engage behind the transversely extending wire $\mathbf{26}_A$ of the lowermost mat SM and the upper end of the element $FP_1$ is secured in place through the stiffener mat ST. Soil is then backfilled and compacted to the level of the uppermost transversely extending wire $\mathbf{14}_P$ of the face panel element $FP_1$. Then the anchor mat AM is placed on the backfill soil so the wire $\mathbf{26}A_P$ is engaged to the outside of the fingers FP of the mat element $FP_1$. These fingers are inclined rearwardly, as with the fingers of the temporary retaining wall embodiment. The next face panel element $FP_2$ is then also engaged behind the wire $\mathbf{26}A_P$ of the mat AM so that its lower most fingers FP extend in interdigitating relationship with the upwardly extending fingers of the mat element $FP_1$, with the fingers of the respective elements extending over and to the outside of the transversely extending wires $\mathbf{14}_P$, $\mathbf{16}_P$, $\mathbf{20}_P$ and $\mathbf{22}_P$. As so disposed, the face panel element $FP_2$ will initially assume a condition inclined backwardly toward the earthen formation, as does the mat FM shown in FIG. 7. After the element $FP_2$ is so placed, soil is backfilled and compacted behind the element and over the anchor mat AM, thus forcing the face panel element $FP_2$ to the vertical condition seen in FIG. 9. Filter mats 36, as shown in FIG. 9, retain the backfilled and compacted soil and function in a diaphragm-like way to transmit pressure to the face panel elements.

Figure 8:
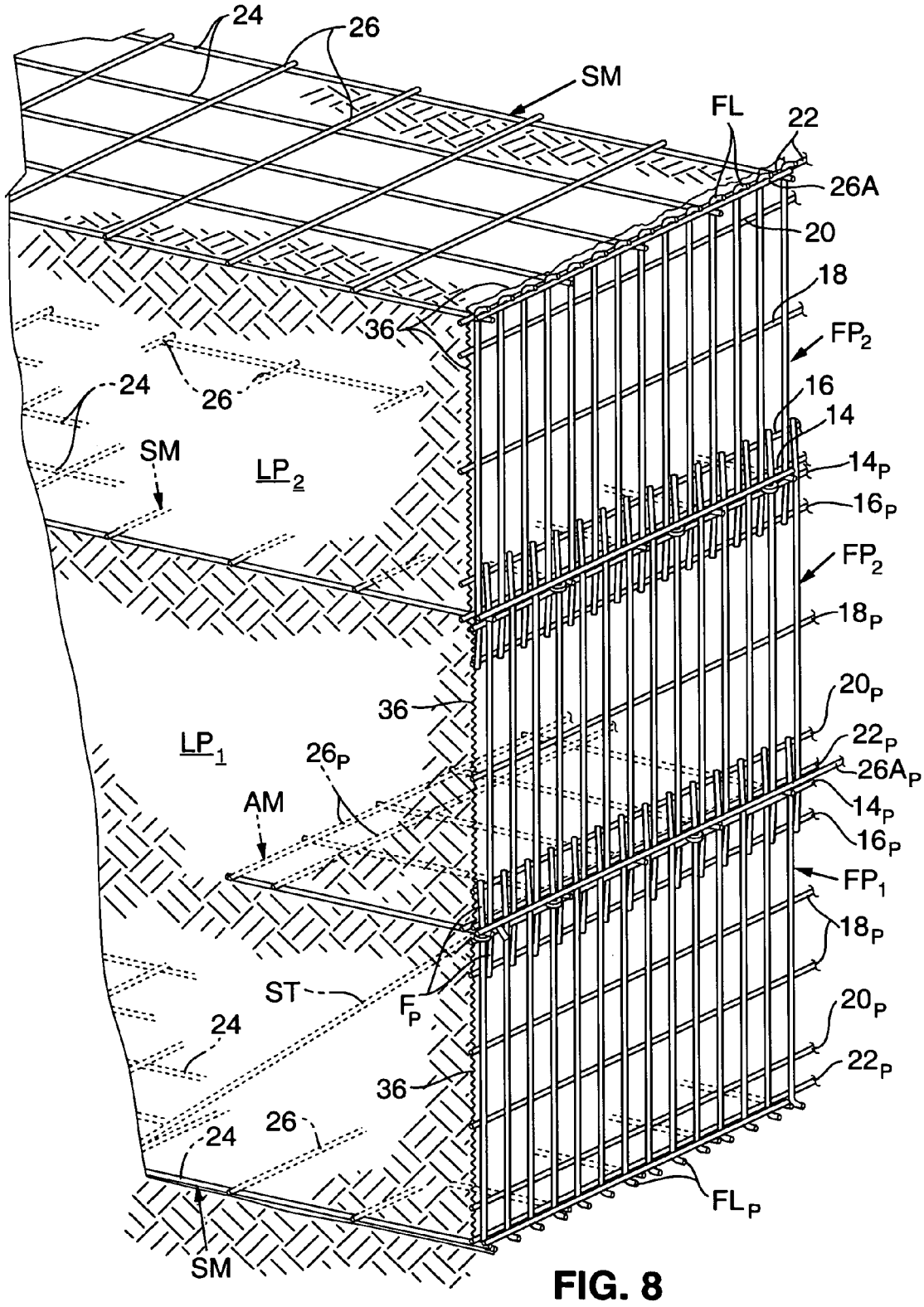
FIG. 8 is a perspective view of a permanent retaining wall constructed according to the present invention.

While FIGS. 8 and 9 illustrate only a lower lift $LP_1$ and the beginning of the next successive lift $LP_2$, it should be appreciated that a fully constructed wall would embody multiple successive such lifts, one above the other, with each successive lift having paired face mat elements secured one above the other in edge-to-edge relationship and anchored by an anchor mat AM, as shown in FIG. 9. The paired face mat elements of the successive mats between the lowermost lift $LP_1$ and the uppermost lift (not illustrated) would each be comprised of a pair of face panel elements corresponding to the elements $FP_2$ wherein backwardly inclined fingers extend from both the upper and lower edges of the panel elements. Initially, each panel element would be backwardly inclined. Upon backfilling and compaction of soil to the upper level of the element, the element would move to vertical. The topmost face panel element of the permanent wall would be of a construction corresponding to that of the element $FP_1$, but inverted so that the outwardly extending fingers $FL_P$ are at the top and extend outwardly. These fingers would hook around the outermost transversely extending wire 26A of a topmost soil reinforcing mat SM, similarly to what is shown for the topmost mat SM of the temporary wall shown in FIG. 6.

Frangible Face Mat Support

Figure 11:
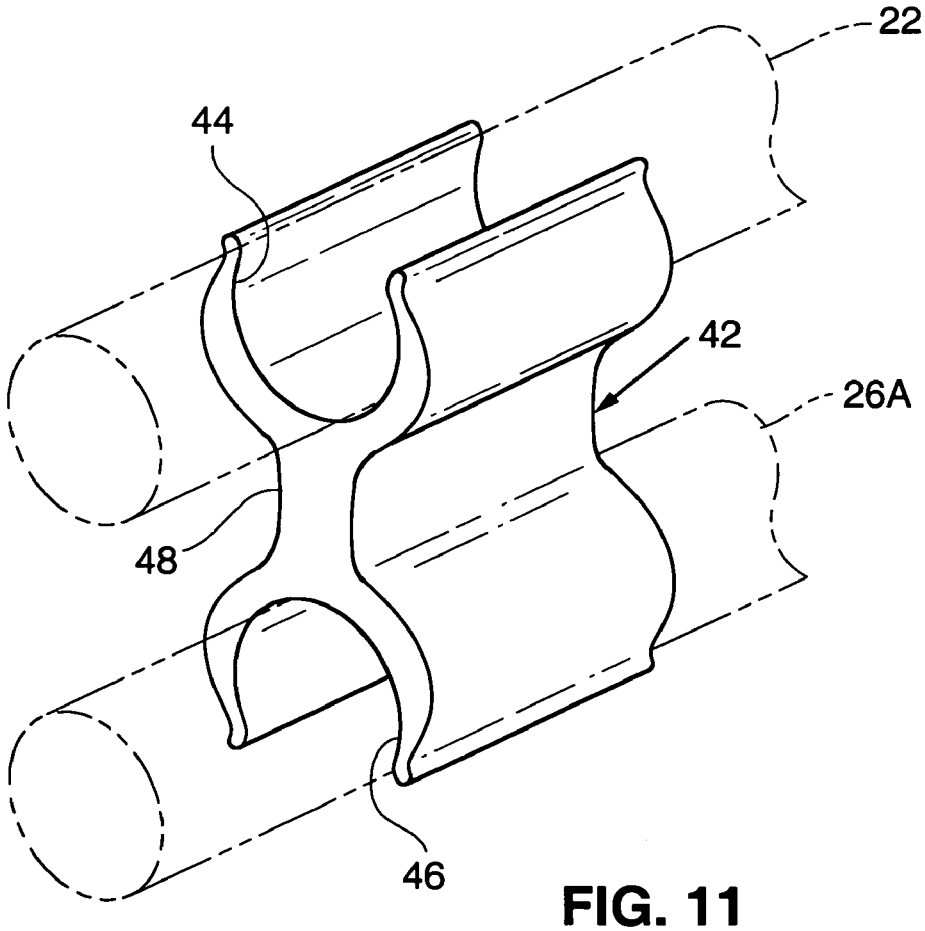
FIG. 11 is a perspective view of the frangible spacer of the invention, as it would appear engaged between two wires, shown in phantom.
Figure 12:
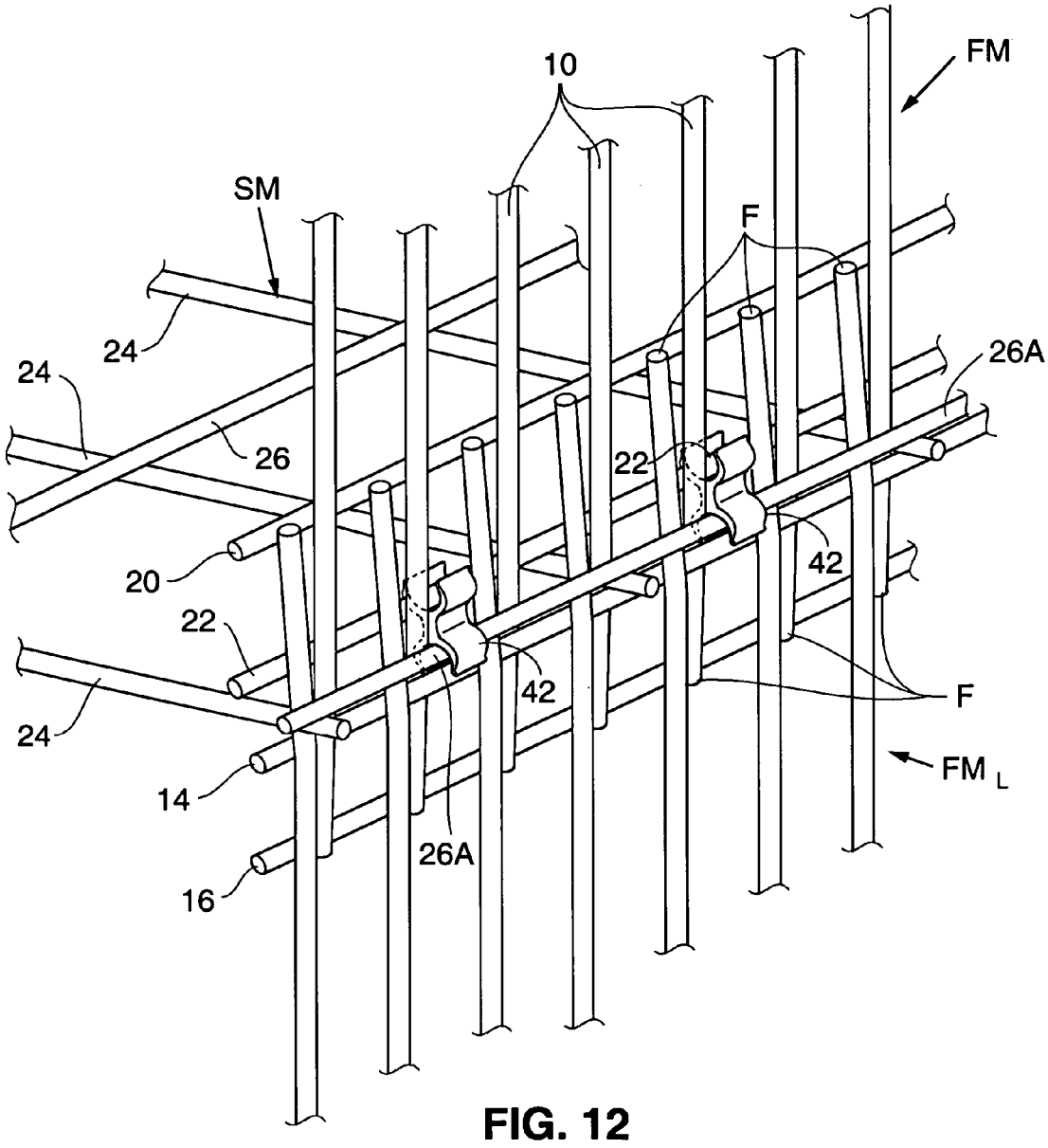
FIG. 12 is a perspective view, with parts thereof broken away, showing the frangible spacer of FIG. 11 engaged between a soil reinforcing mat and the face mat thereabove.
Figure 13:
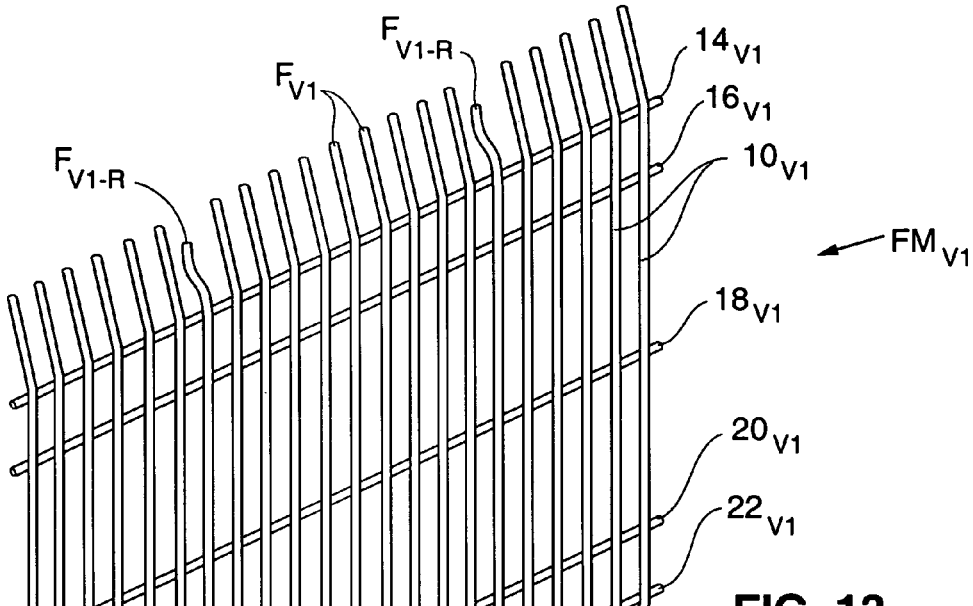
FIG. 13 is a perspective view of a first variation of the unitary face mat of the present invention, wherein certain of the fingers extending distally from the upper portion of the mat are bent inwardly.

FIGS. 11 and 12 show a frangible spacer 42 engaged between the lowermost transverse wire 22 of a face mat element FM and the transverse wire 26A of the soil reinforcing mat SM immediately therebelow, to hold the face in elevated condition relative to the soil reinforcing mat. The spacer comprises a body having bifurcated ends 44 and 46 proportioned to snap into engagement around the transverse wires and a web portion 48 disposed between the bifurcated portions to maintain the wires received within the bifurcated portions in spaced relationship.

The spacer 42 may be fabricated of any suitable material, such as extruded aluminum or a polymer, and is of such strength that the web portion 48 will fracture to release the wires 22 and 26A for movement toward one another in the event the face mat supported on the spacer is overloaded as the result of settling of the earthen formation. Fracturing of the web 42 permits the wires 22 and 26A to move toward one another to accommodate such overloading, without bowing of the face panel.

In an assembled wall, a multiplicity of spacers 42 would be provided between adjacent transversely extending wires 22 and 26A, at spaced intervals. The spacers 42 could be used as an alternative to the compressible support members at the top of the face mats, or as an addition thereto; the purpose of both the compressible support members 34 and the frangible spaces 42 being to permit successive soil reinforcing mats to move toward one another in response to settling of the retained earthen formation, without bowing of the face mats.

First Variation Face Mat

The first variation face mat, as shown in FIGS. 13, 16, 17 and 18 is designated in its entirety as $FM_{V1}$. It may be used in either the temporary or permanent embodiment of the present invention. As shown, it is intended for a permanent wall having two foot lifts, without the intermediate anchor mats AM of the previously described permanent embodiment.

Elements of the first variation face mat $FM_{V1}$ 1 corresponding to those of the face mats FM are designated by like numerals, followed by the subscript V1, as follows:

Fingers $F_{V1}$

Vertical wires $\mathbf{10}_{V1}$

Horizontal wire $\mathbf{14}_{V1}$

Horizontal wire $\mathbf{16}_{V1}$

Horizontal wire $\mathbf{18}_{V1}$

Horizontal wire $\mathbf{20}_{V1}$

Horizontal wire $\mathbf{22}_{V1}$

In addition to the first pluralities of fingers $F_{V1}$, the first variation face mat has a second plurality (only two as shown) of rearwardly curved fingers $F_{V1\text{-}R}$. These fingers are gently curved and designed to frictionally support the lowermost horizontal wire $\mathbf{22}_{V1}$ of the next successive face mat thereabove (see FIGS. 17 and 18). Such support serves to space the lowermost horizontal wire $\mathbf{22}_{V1}$ from the uppermost horizontal wire $\mathbf{14}_{V1}$ of the mat therebelow. Upon settling of an earthen formation retained by the mats, the horizontal wire $\mathbf{22}_{V1}$ may slide downwardly along the fingers $F_{V1-R}$ to accommodate compression of the face panels, without bulging.

Figure 16:
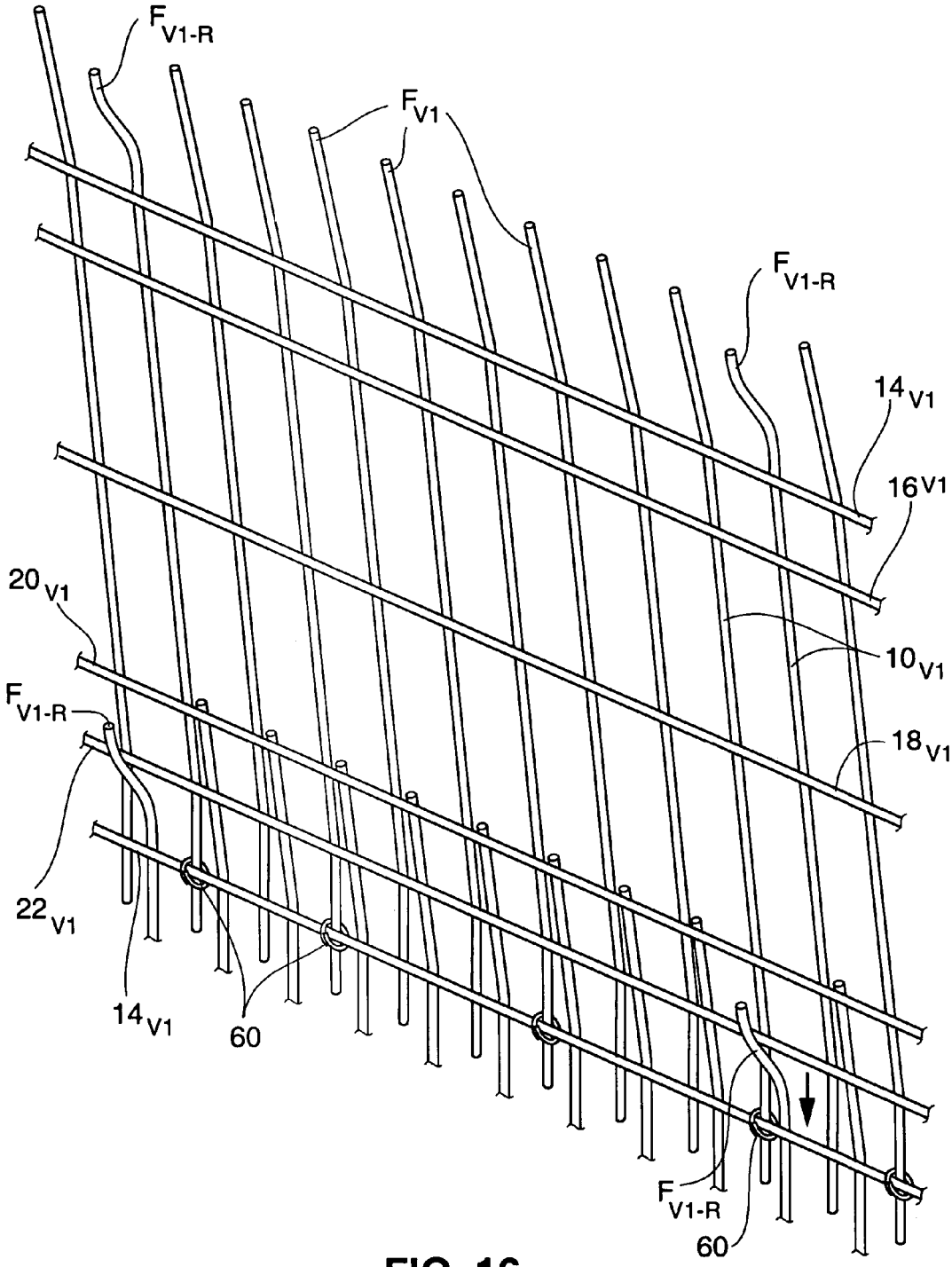
FIG. 16 is a enlarged perspective view illustrating how a pair of the first variation face mats inter-engage.
Figure 17:
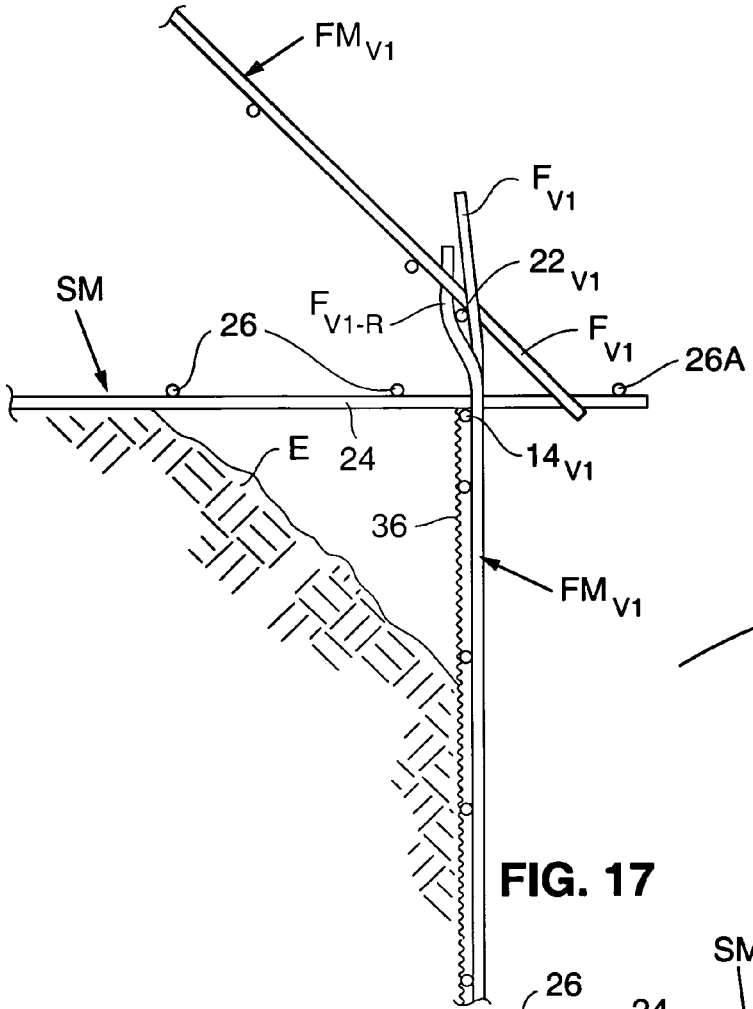
FIGS. 17 and 18 are cross-sectional elevational views through the face of a soil reinforced retaining wall being constructed with face mats according to the first variation face mat shown in FIG. 13, illustrating the steps of placing and securing the face mat.
Figure 18:
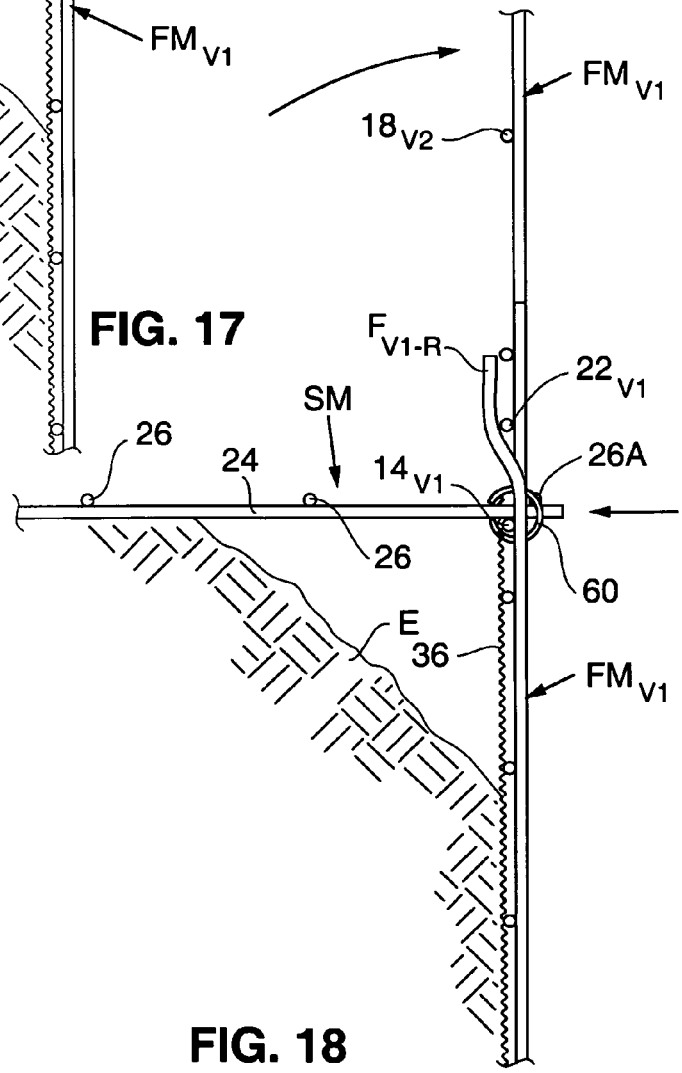

FIGS. 17 and 18 show an upper mat $FM_{V1}$ being engaged with a mat $FM_{V1}$ immediately therebelow. As shown in FIG. 17, the wire $\mathbf{22}_{V1}$ is received between the fingers $F_{V1}$ and $F_{V1-R}$. FIG. 18 shows the upper mat $FM_{V1}$ swung to a vertical orientation and secured in place with a hog ring 60. With the face mat so secured, the fingers $F_{V1}$ of the engaged mats assume a generally vertical aligned condition, as shown in FIG. 18. This inter-relationship may also be seen from FIG. 16. The arrow line in FIG. 16 is intended to show how the wire $\mathbf{22}_{V1}$ of the upper face mat there shown may move toward the wire $\mathbf{14}_{V1}$ of the lower face mat, as an earthen formation settles. FIGS. 17 and 18 show soil, designated E, partially backfilled into place. In the completed wall, the space behind the face mats is fully backfilled, and the backfill soil is retained behind the face mats by filter mats 36.

The soil mats SM used with the first variation face mat are the same as those used with the other embodiments herein described. One such soil mat SM is shown in FIGS. 17 and 18, in the process of being installed. In FIG. 17, the mat SM is engaged over the lower face mat $FM_{V1}$ with the outermost transversely extending wire $^{26}$A disposed to the outside of the lower mat $FM_{V1}$ and the downwardly extending finger $F_{V1}$ of the upper mat. FIG. 18 shows the mat SM pulled back into the formation so that the transversely extending wire $\mathbf{26}_A$ of the mat engages the fingers $F_{V1}$ and $F_{V1-R}$ of the respective face mats, to hold the mats against outward displacement relative to the earthen formation.

Second Variation Face Mat

Figure 14:
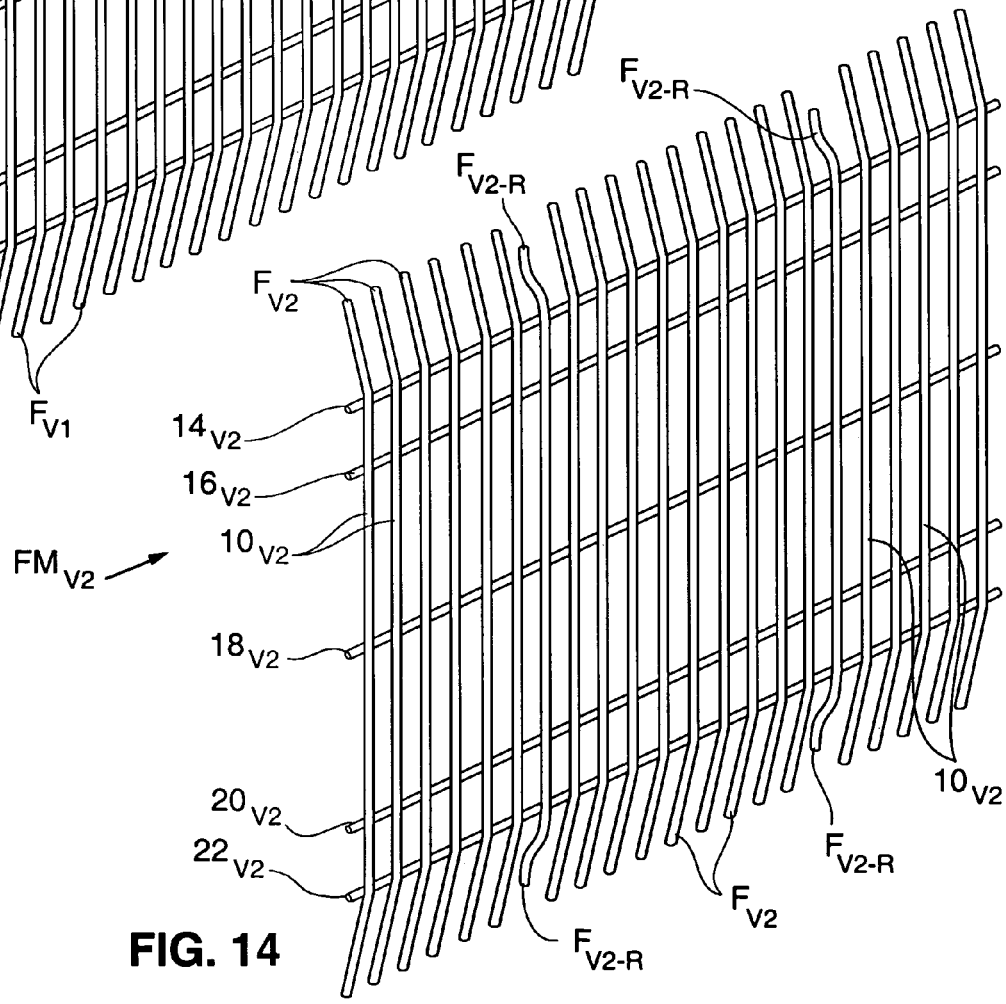
FIG. 14 is a perspective view of a second variation of the unitary face mat of the present invention, wherein certain of the fingers extending distally from both the upper and lower portions of the mat are bent inwardly.
Figure 15:
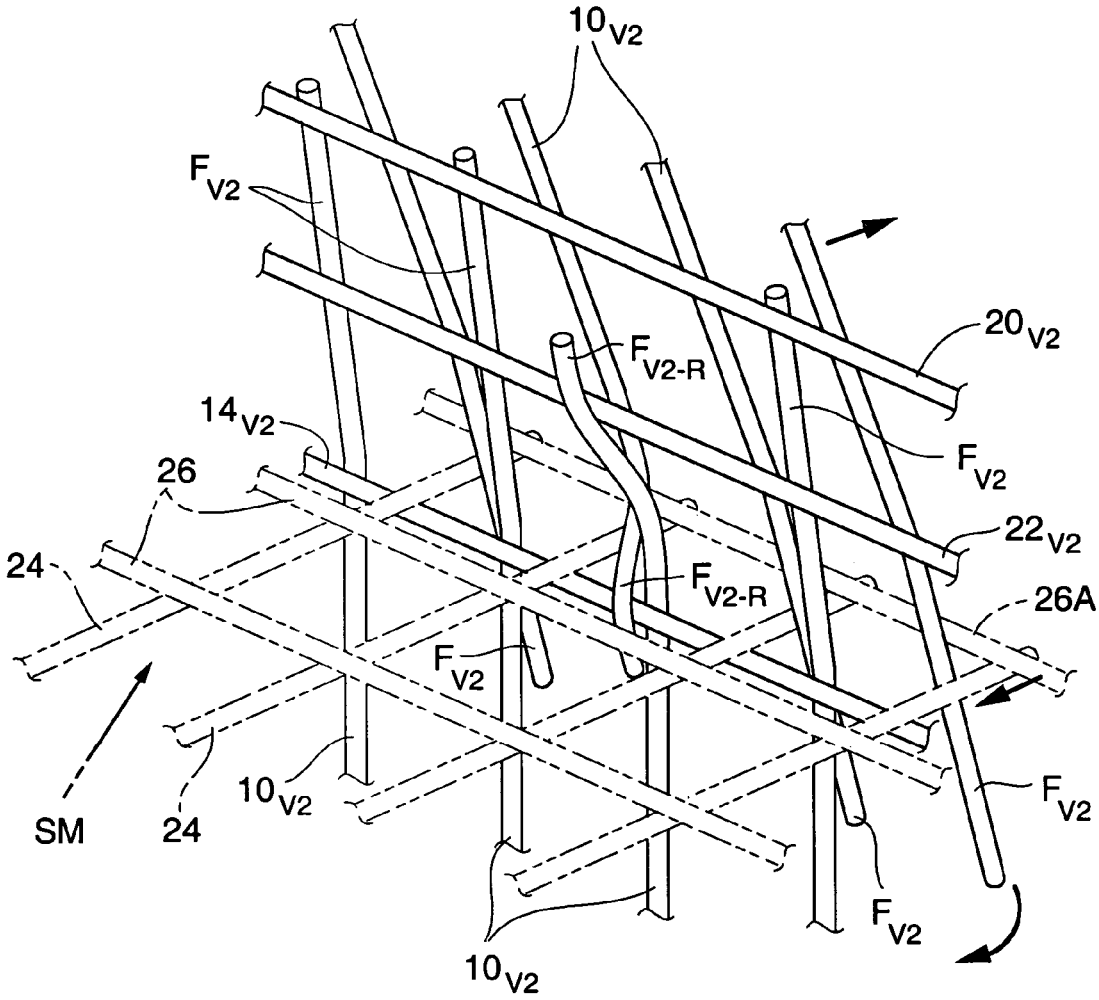
FIG. 15 is a perspective view illustrating how a pair of the second variation face mats of FIG. 14 inter-engage, with the soil reinforcing mat which cooperates therewith shown in phantom lines.

The second variation face mat, designated $FM_{V2}$, may best be seen from FIGS. 14 and 15. It corresponds to the first variation face mat $FM_{V1}$, except that gently curved rearwardly extending fingers, designated $F_{V2-R}$ extend from both the top and bottom of the face mat.

The parts of the second variation face mat $FM_{V2}$ have designations similar to those of the first variation face mat $FM_{V1}$, with the subscript V2, as follows:

Fingers $F_{V2}$
Rearwardly curved fingers $F_{V2-R}$
Vertical wires $\mathbf{10}_{V2}$
Horizontal wire $\mathbf{14}_{V2}$
Horizontal wire $\mathbf{16}_{V2}$
Horizontal wire $\mathbf{18}_{V2}$
Horizontal wire $\mathbf{20}_{V2}$
Horizontal wire $\mathbf{22}_{V2}$ FIG. 15 shows the manner in which the pair of upper and lower second variation face mats $F_{V2}$ are engaged and held against outward displacement by a soil reinforcing mat SM. As there illustrated, the fingers $F_{V2}$ of the lower face mat extend over and to the outside of the horizontal wires $\mathbf{20}_{V2}$ and $\mathbf{22}_{V2}$ of the upper face mat; and the downwardly extending fingers $F_{V2}$ of the upper face mat extend to the outside of the horizontal wires $\mathbf{14}_{V2}$ of the lower face mat. The rearwardly extending fingers $F_{V2-R}$ of the lower face mat extend into slidable engagement with the horizontal wire $\mathbf{22}_{V2}$ of the upper face mat. The downwardly extending wire $F_{V2-R}$ of the upper face mat extends into slidable engagement with the interior of the horizontal wire $\mathbf{14}_{V2}$ of the lower face mat. As a result of the engagement of the rearwardly curved fingers of the respective face mats with the horizontal wires $\mathbf{14}_{V2}$ and $\mathbf{22}_{V2}$, the face mats are held in close to vertical alignment. No hog rings, such as the ring 60 of the first variation face mat are required. The slidable engagement of the fingers $F_{V2-R}$ with the horizontal wires $\mathbf{14}_{V2}$ and $\mathbf{22}_{V2}$ permits the face mats to move toward one another as the retained earthen formation settles, without bulging of the face mats.

FIG. 15 also shows how the soil reinforcing mat SM is engaged between the face mats so that the outermost transversely extending wire $\mathbf{26}_A$ of the mat SM engages to the outside of the fingers $F_{V2}$ and $F_{V2-R}$. The arrow line leading from the mat SM depicts how the mat is forced against the fingers to hold the face mats in place. The straight arrow line shown at the top of FIG. 15 and curved arrow line shown at the bottom depicts how the upper face mat is swung into general vertical alignment with the lower face mat, during the course of assembly of the composite made up of the upper and lower face mats $F_{V2}$ and the soil reinforcing mat SM.

Third Variation Face Mat

Figure 19:
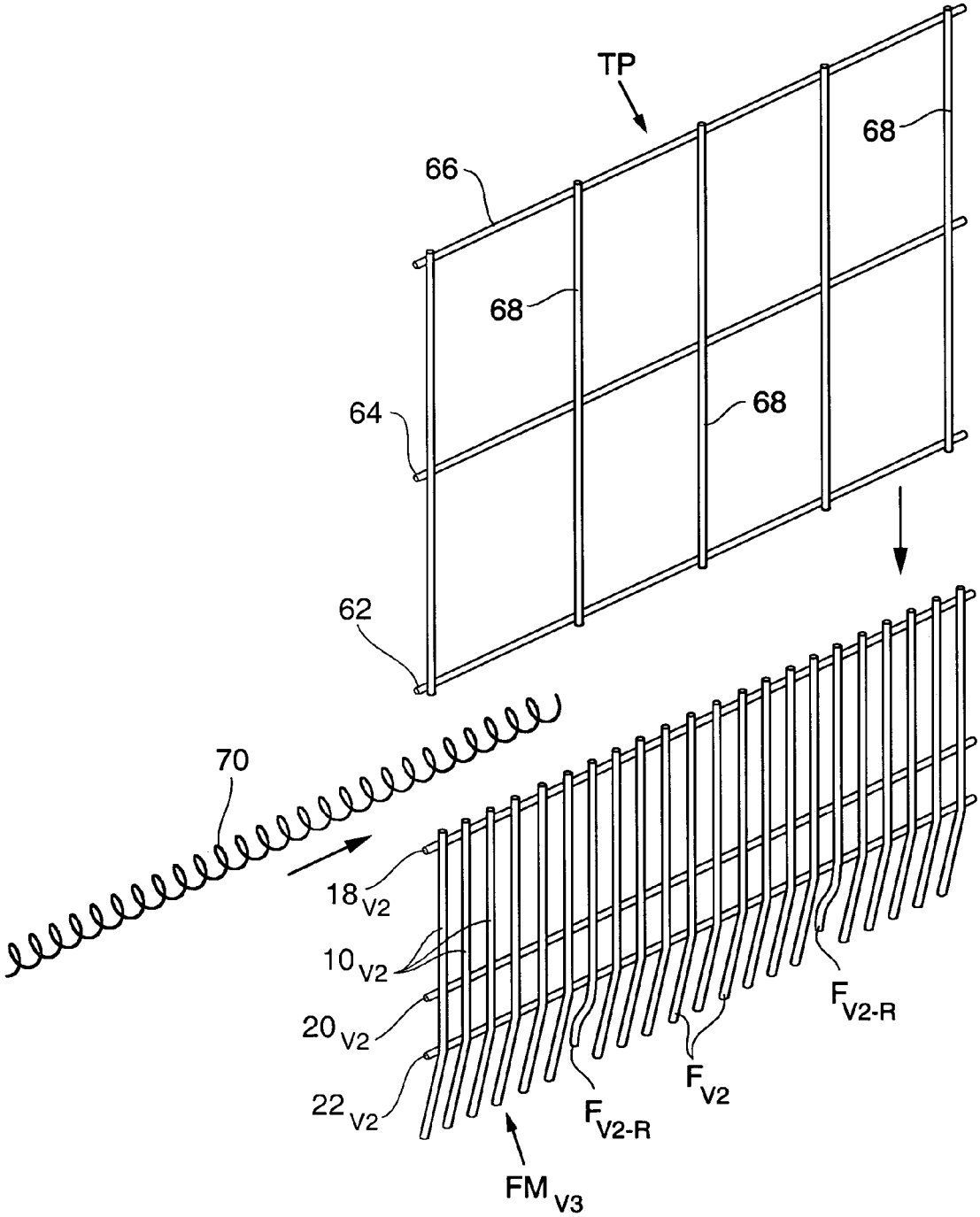
FIG. 19 is an exploded perspective view illustrating a third variation of the unitary face mat of the present invention, which may be used to cap the soil reinforced retaining wall, with an anchoring tail piece and a hinge spiral for use in connecting a tail piece to the face mat.

The third variation face mat (see FIG. 19) is designed to provide a capping face for a soil reinforced wall constructed according to the present invention. The mat, designated in its entirety as $FM_{V3}$, comprises elements corresponding to those of the lower half of the second variation mat $FM_{V2}$. These are designated, as follows:

Fingers $F_{V2}$
Rearwardly curved fingers $F_{V2-R}$
Vertical wires $\mathbf{10}_{V2}$
Horizontal wire $\mathbf{18}_{V2}$
Horizontal wire $\mathbf{20}_{V2}$
Horizontal wire $\mathbf{22}_{V2}$ In use, the third variation face mat $FM_{V3}$ is engaged with the face mat and soil reinforcing mat therebelow in a manner identical to that which has been described with respect to FIG. 15. The uppermost horizontal wire $\mathbf{18}_{V2}$ of the third version face mat $FM_{V3}$ serves as part of a hinge for tail piece TP. The Tail piece is a welded wire grid work comprised of horizontal wires 62, 64 and 66 and vertical wires 68. A wire spiral 70 is threaded around the wires $\mathbf{18}_{V2}$ and 62 to hingedly secure the tail piece to the top of the face mat $FM_{V3}$, for movement between the conditions shown in FIGS. 22 and 23.

Starter Mat

Figure 20:
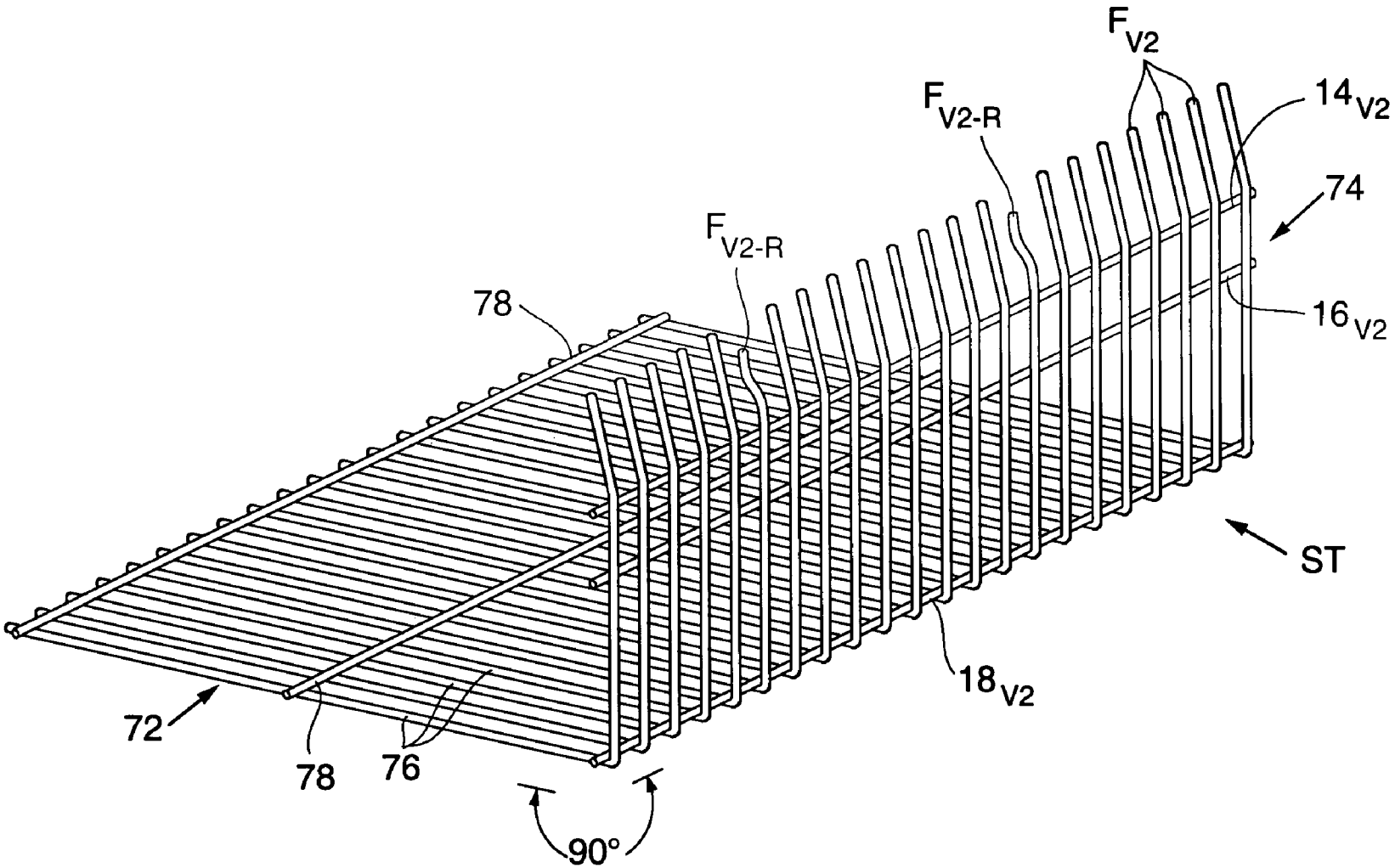
FIG. 20 is a perspective view of a starter mat for use at the foot of an earthen formation being retained with a soil reinforced retaining wall constructed according to the present invention.

This mat is shown in FIG. 20 and designated ST. It is of a welded wire construction and includes a floor section 72 and a face section 74, disposed at right angles relative to one another. The face section 74 has a construction corresponding to upper half of the second variation face mat $FM_{V2}$. Floor section 72 is formed by longitudinal wires 76 having transverse wires 78 extending thereacross. The longitudinal wires 76 of the floor section are continuous with the vertical wires of the face section 74. Elements of the face section, corresponding to the upper half of the second variation face mat $FM_{V2}$, are designated by like numerals, as follows:

Fingers $F_{V2}$
Rearwardly curved fingers $F_{V2-R}$
Horizontal wire $\mathbf{14}_{V2}$
Horizontal wire $\mathbf{16}_{V2}$
Horizontal wire $\mathbf{18}_{V2}$ In use, the face section 74 of the starter mat ST is engaged with the face mat and soil reinforcing mat thereabove, in a manner identical to that which is illustrated in FIG. 15.

Figure 21:
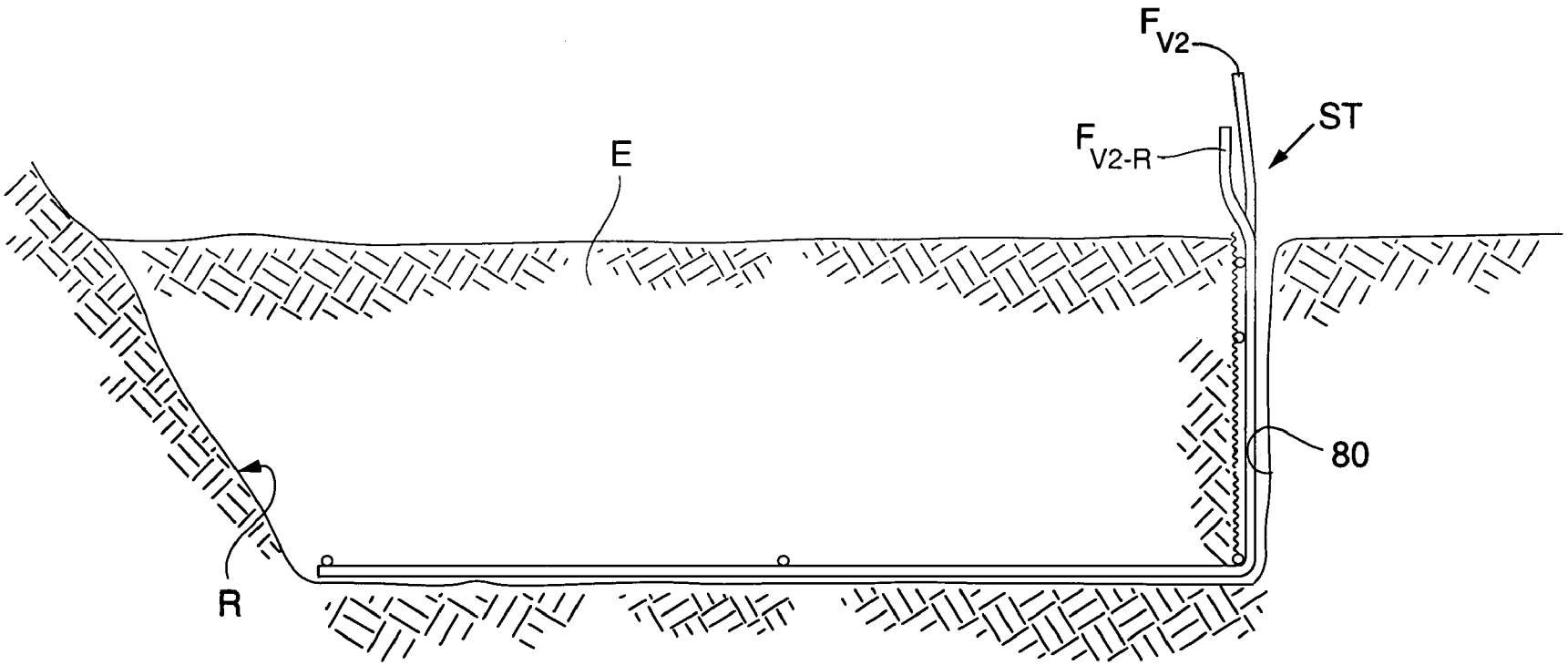
FIG. 21 is a cross-sectional elevational view showing the starter mat of FIG. 20 received within a recess formed at the foot of the formation being retained, with backfill placed over the starter mat.
Figure 22:
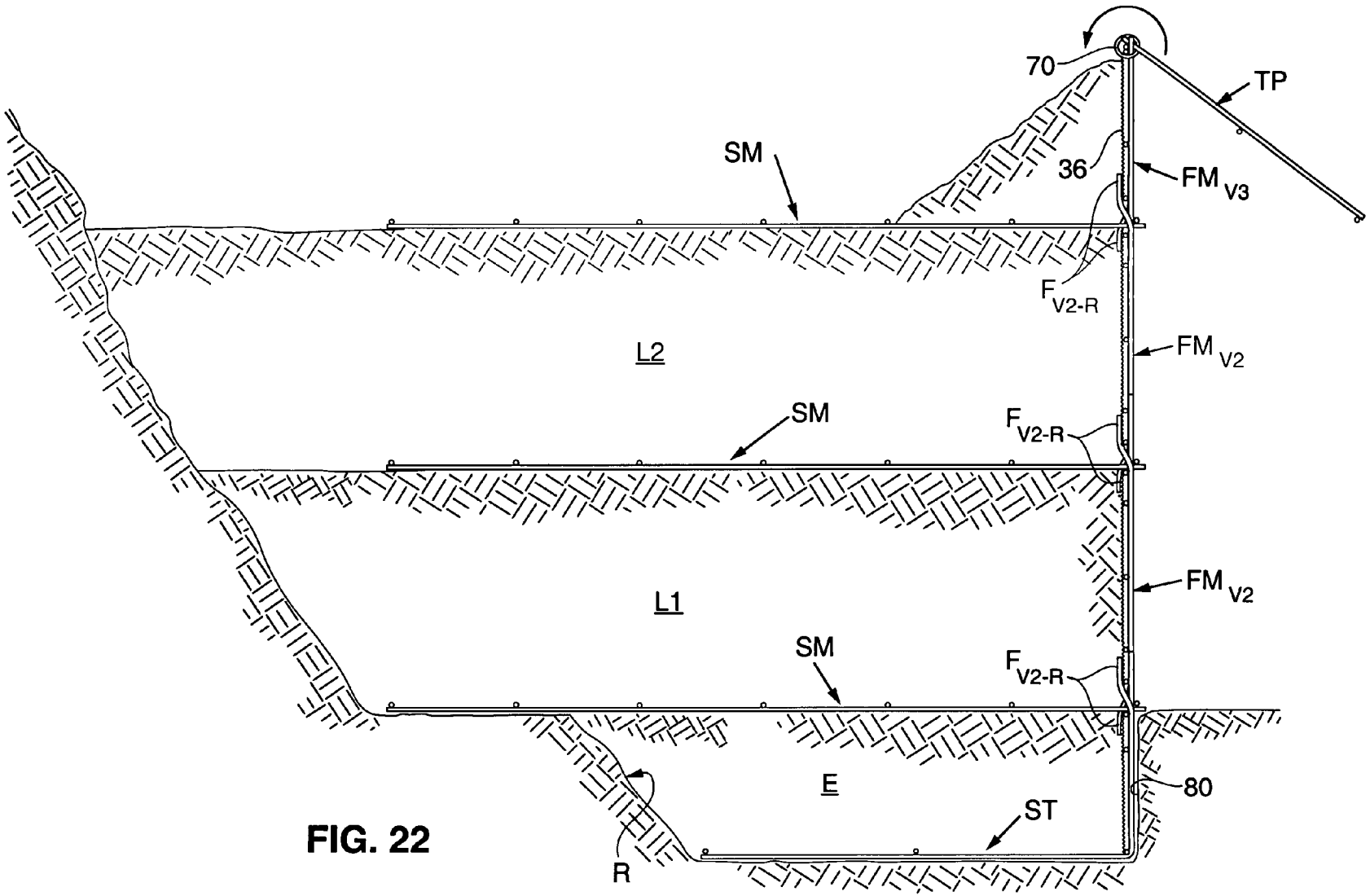
FIG. 22 is a cross-sectional elevational view of a retaining wall constructed with the second variation face mats of FIG. 14, and capped with the third variation face mat and anchoring tail piece of FIG. 19, prior to movement of the tail piece over the partial backfill behind the third variation face mat at the top of the wall.
Figure 23:
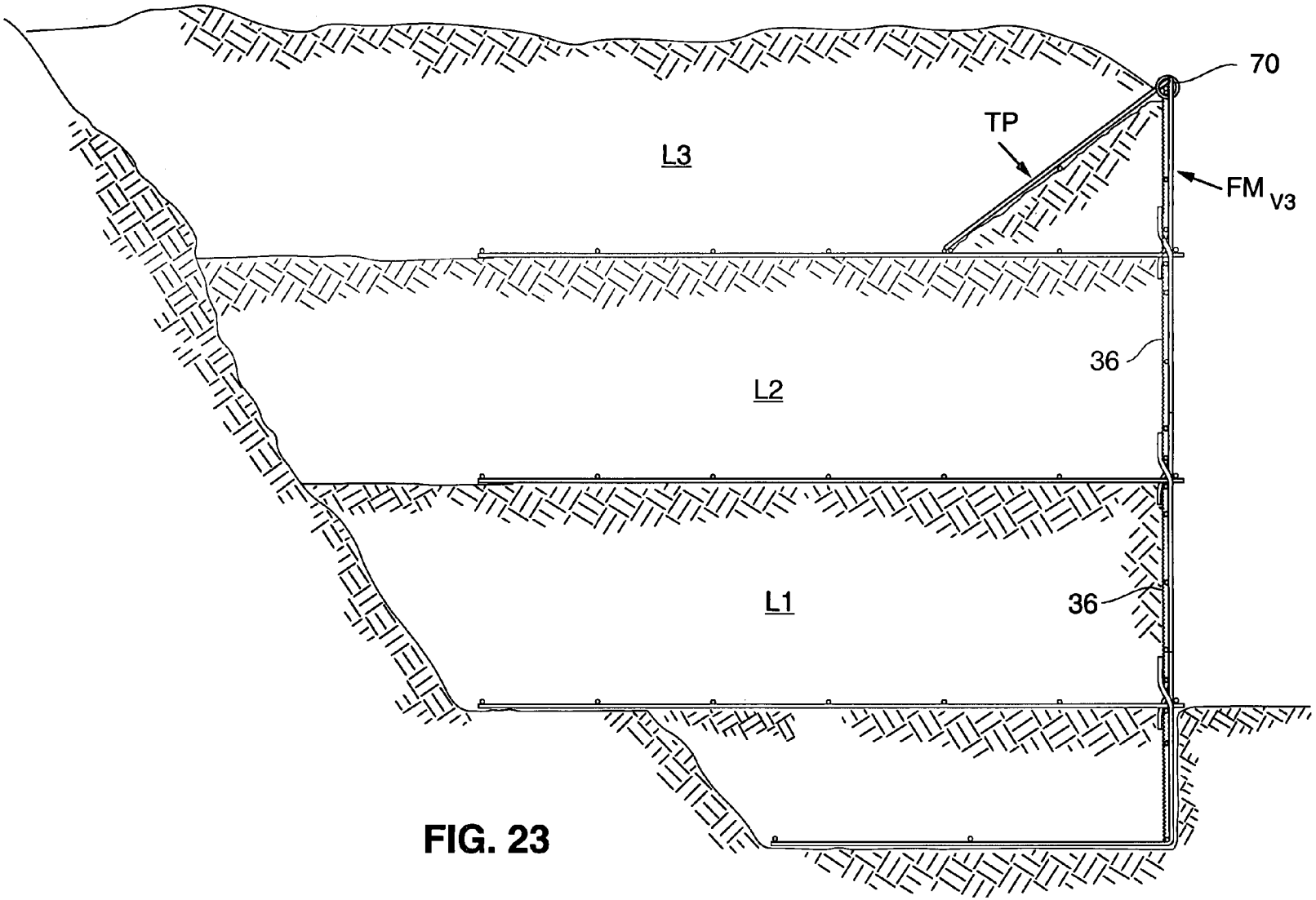
FIG. 23 is a cross-sectional elevational view corresponding to FIG. 22, illustrating the completed wall, with the anchoring tail piece in place within the backfill of the upper lift of the wall.

The method of constructing a soil reinforced retaining wall, commencing with the starter mat ST, is shown in FIGS. 21 through 23. This comprises the following steps:

1. A recess R proportioned for receipt of the starter mat ST is excavated at the foot of the formation. The recess includes an upstanding wall 80 against which the face section 74 of the mat ST may rest.
2. The starter mat ST is positioned in the recess R, as shown in FIG. 21 and backfill soil E is filled in over the mat to approximately ground level.
3. Soil reinforcing mats and face mats are successively engaged with and above the starter mat, with backfill soil placed over each soil reinforcing mat, as seen in the first and second lifts L1 and L2 depicted in FIG. 22. During the course of this construction, the fingers on the face mats inter-engage in the manner shown in FIG. 15 and filter mats 36 are disposed to the interior of the face mats prior to placement of the backfill.
4. A soil reinforcing mat SM, with a third variation face mat $FM_{V3}$ are assembled over lift L2, with the tail piece TP swung to the outside of the wall, as shown in FIG. 22.
5. A filter mat 36 is placed behind the mat $FM_{V3}$ and backfill is partially loaded thereover, as seen in FIG. 22 (the backfill may take the form of soil and/or rock).
6. The tail piece TP is swung to the inside of the face mat $FM_{V3}$ so as to rest on the partial backfill, as seen in FIG. 23.
7. A final layer of finish backfill is filled in over the uppermost soil reinforcing mat SM and the tail piece TP, as seen in FIG. 23. This completes the top-most lift, designated L3 in FIG. 23.

Although the wall depicted in FIGS. 22 and 23 is shown as being constructed with a second variation face mat $FM_{V2}$, it should be appreciated that it could be constructed with the first variation face mat $FM_{V1}$. The principal difference in construction simply being that use of the $FM_{V1}$ face mat would require hog rings, as shown in FIG. 18. Regardless of which version of face mat is employed, provision of the starter mat ST provides a stable foundation, with a vertically extending face, upon which the face mats of the wall may be erected.

Second Variation Soil Reinforcing Mat

Figure 24:
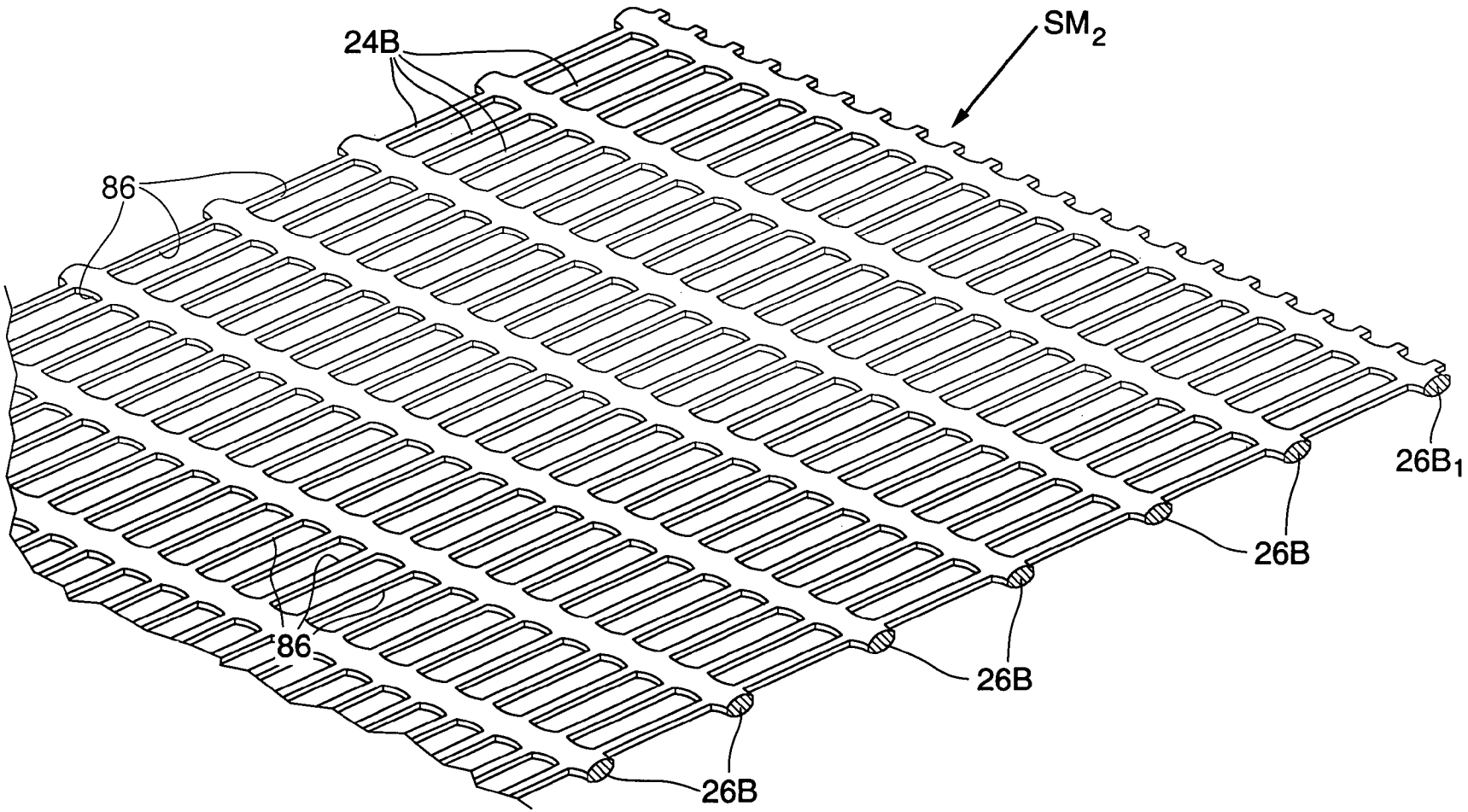
FIG. 24 is a perspective view of a flat polymer geogrid which may be used for the soil reinforcing mat of the present invention.
Figure 25:
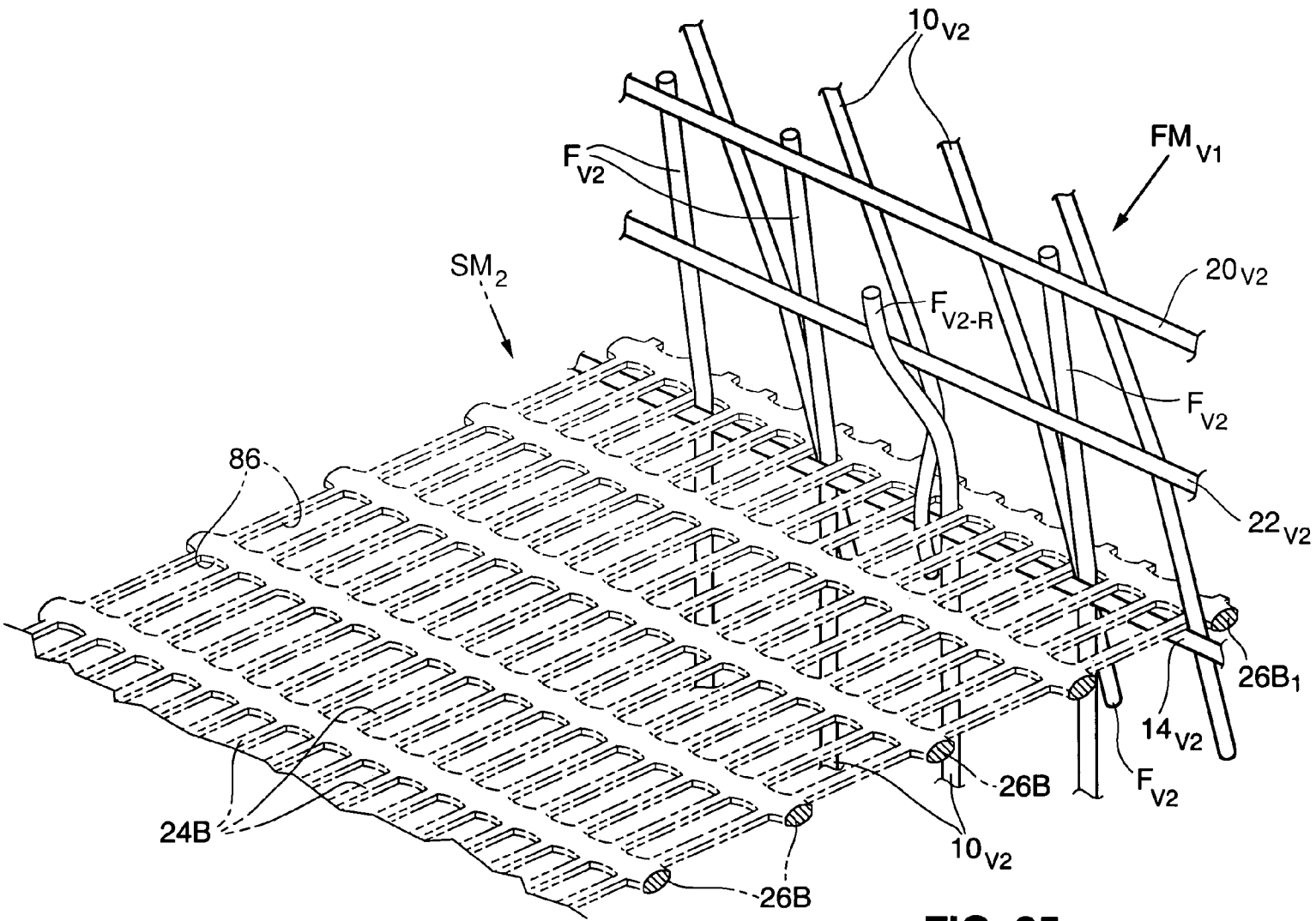
FIG. 25 is a perspective view similar to FIG. 15, with parts thereof broken away and shown in phantom, illustrating the polymer geogrid reinforcing mat of FIG. 24 having the second variation face mats engaged therewith.

This mat, designated $SM_2$, is seen in FIG. 24 and comprises a polymer geogrid having longitudinal elements $\mathbf{24}_B$ and intersecting enlarged transverse elements $\mathbf{26}_B$, defining therebetween apertures 86. The forward distal-most transverse element of the mat $SM_2$ is designated $\mathbf{26}_{B1}$. The geogrid may take any suitable commercially available form, such as that sold by the Tensar Corporation of Atlanta, Ga. under the trademark TENSAR. Such polymer grids are of high tensile strength, chemically inert, and developed specifically for long term soil reinforcement applications.

The mat $SM_2$ is incorporated into the soil reinforced wall of the present invention in a manner corresponding to that of the aforedescribed welded wire mat SM. The elements $\mathbf{24}_B$, $\mathbf{26}_B$ and $\mathbf{26}_{B1}$ function similarly to the elements 24, 26 and 26A, respectively. Fingers $F_{V2}$, $F_{V2\text{-}R}$ extend through the apertures 86, with the distal transverse element $\mathbf{26}_B$ disposed to the outside of the fingers. Mat $SM_2$ rests upon the horizontal wire $\mathbf{14}_{V2}$ of the lower face mat.

Figure 26:
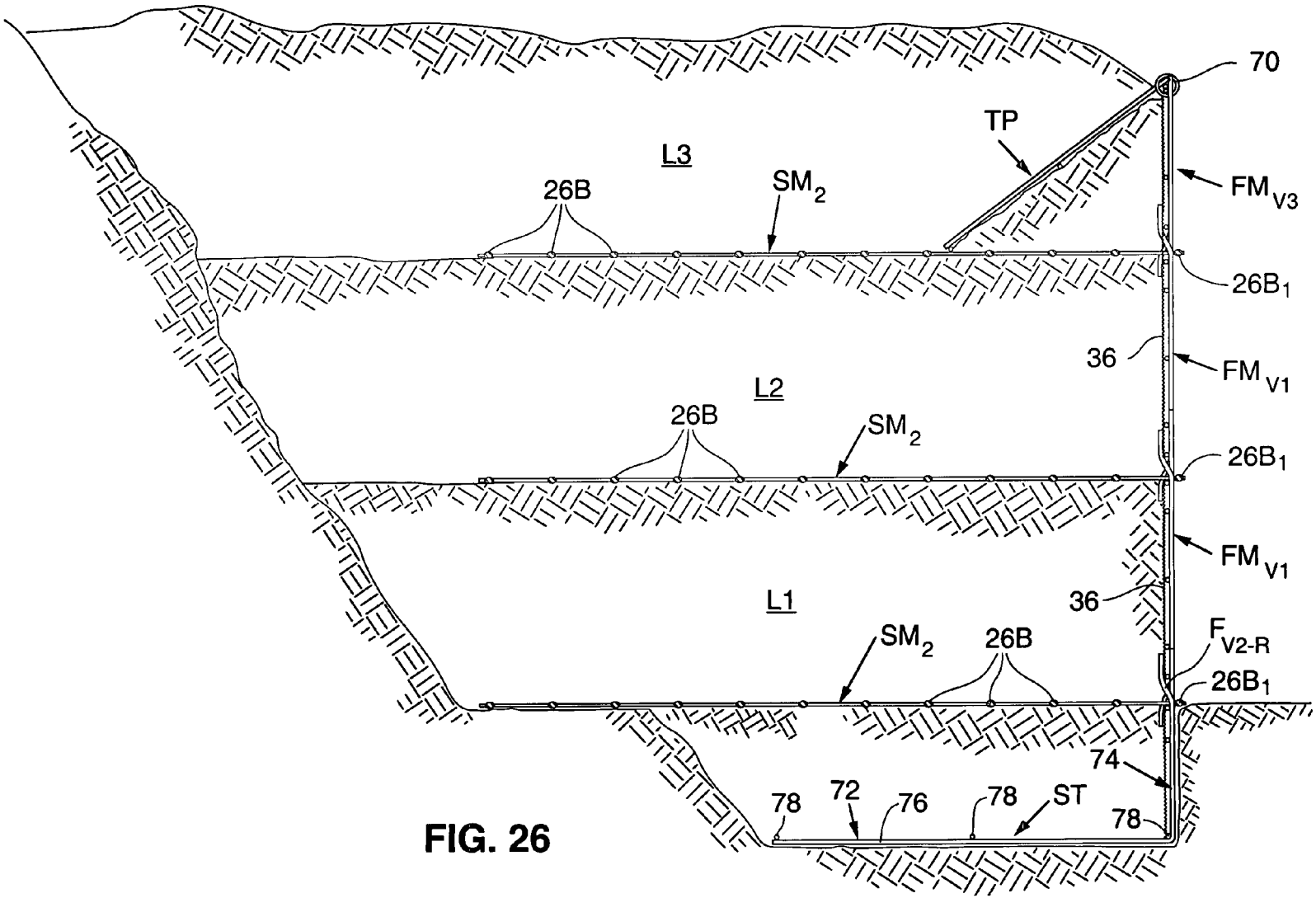
FIG. 26 is a cross-sectional elevational view similar to FIG. 23, illustrating a completed wall wherein the soil reinforcing mats comprise polymer geogrids, as shown in FIGS. 24 and 25.

FIG. 26 illustrates the soil reinforcing mat $SM_2$ incorporated into a wall constructed to the present invention. As there seen, the starter mat ST and the anchoring tail piece TP are assembled into place in a manner corresponding identically to that previously described with reference to FIGS. 22 and 23. The only difference is that the geogrid mats $SM_2$ have been substituted for the welded wire mats SM.

Elements of FIG. 26 corresponding to those of FIGS. 22 and 23 are designated by like reference characters. Distal transverse elements $\mathbf{26}_{B1}$ extend across the outside of the welded wire face mats $FM_{V1}$ and $FM_{V3}$ and that filter mats 36 are disposed interiorally of the face mats.

CONCLUSION

From the foregoing description, it is believed apparent that the present invention enables the attainment of the objects initially set forth herein. In particular, it provides a soil reinforced earthen retaining wall wherein the soil reinforcing mats and face mats are of a simplified flat construction and so constructed and assembled that increased lift height may be accommodated with uniform backfilling and compaction. It should be understood, however, that the invention is not limited to the specifics of the described embodiments, but rather is defined by the accompanying claims.

We claim:

1. A structure for retaining and reinforcing an earthen formation and securing a face of the formation against sloughing, said structure comprising:

a) successive soil reinforcing mats embedded in the formation at vertically spaced intervals, each said reinforcing mat being generally horizontally disposed and of a planar configuration without upstanding portions at the face of the formation and comprised of an apertured polymer body extending into the formation, said body terminating at the face of the formation, and having a transverse element extending across the face; and b) a welded wire face mat disposed at the face of the formation between each successive pair of soil reinforcing mats, each of said face mats comprising:

i. transverse wires at upper and lower portions thereof and spaced generally vertical wires welded to and extending across the transverse wires;

ii. a first plurality of generally vertical wires extending distally and upwardly therefrom to provide fingers extending over the transverse wire at the lower portion of the next successive face mat and behind the transverse element of the soil reinforcing mat extending across the face between the successive face mats; and iii. a second plurality of the generally vertical wires extending distally and upwardly therefrom in a curved path extending toward the formation to provide curved fingers extending behind and in frictional engagement with the transverse wire at the lower portion of the next successive face mat.

2. A structure according to claim 1, wherein each of the face mats further comprise a plurality of the generally vertical wires extending distally and downwardly therefrom in a gently curved path extending toward the formation to provide curved fingers extending behind and in frictional engagement the transverse wire at the upper portion of the next successive face mat therebelow.

3. A structure according to claim 1 wherein each successive soil reinforcing mat rests on a transverse wire of the face mat immediately therebelow.

4. A method for retaining and reinforcing an earthen formation and securing a face of the formation against sloughing, said method comprising:

a) excavating a foot portion of the formation to provide a recess having a floor with an upstanding wall at one end thereof, said wall being disposed so as to be in general alignment with the face of the formation;

b) placing a first welded wire foundation mat in the recess, said foundation mat being of an L-shaped configuration with a generally horizontally disposed portion resting on the floor and upstanding portion extending over and engaged with the upstanding wall, and comprised of spaced longitudinal wires extending continuously over the horizontal and upstanding portions, said foundation mat having a first plurality of generally straight wires extending distally from the upstanding portion and a second plurality of wires extending distally from the upstanding portion in a curved path extending toward the formation, and transverse wires extending across and welded to the longitudinal wires at spaced intervals;

c) backfilling and compacting soil over the foundation mat to fill the recess, while leaving the first and second pluralities of wires extending upwardly and outwardly of the backfilled soil;

d) placing a first soil reinforcing mat on the backfilled soil in a generally horizontal disposition, said first reinforcing mat being of a planar configuration and comprised of an apertured polymer body having a transverse element extending across the face of the formation to the outside of the first and second pluralities of wires;

e) securing a first welded wire face mat behind the transverse element of the first soil reinforcing mat extending across the face of the formation, said first face mat having uppermost and lowermost transverse wires and spaced generally vertical wires welded to and extending across the transverse wires thereof and being positioned so that the first plurality of wires extend to the outside of lowermost transverse wire and the second plurality of wires extend to frictional engagement with the inside of the lowermost transverse wire;

f) backfilling and compacting soil over the first soil reinforcing mat and against the first face mat; and, g) placing a second soil reinforcing mat on the soil backfilled over the first soil reinforcing mat so that one end of the second soil reinforcing mat is engaged with the first face mat to restrain the first face mat against outward displacement, said second soil reinforcing mat being generally horizontally disposed and of a planar configuration without upstanding portions at the face of the formation and comprised of an apertured polymer body having a transverse element extending across the face and in front of the first face mat.

* * * * *